US008404958B2

(12) United States Patent
Shrem et al.

(10) Patent No.: US 8,404,958 B2
(45) Date of Patent: Mar. 26, 2013

(54) ADVANCED MIDI AND AUDIO PROCESSING SYSTEM AND METHOD

(75) Inventors: Yuval Shrem, Los Angeles, CA (US); Amit Itzkovich, Los Angeles, CA (US)

(73) Assignee: Fable Sounds, LLC, Los Angeles, CA (US)

( * ) Notice: Subject to any disclaimer, the term of this patent is extended or adjusted under 35 U.S.C. 154(b) by 0 days.

(21) Appl. No.: 13/039,092

(22) Filed: Mar. 2, 2011

(65) Prior Publication Data

US 2011/0146479 A1 Jun. 23, 2011

Related U.S. Application Data

(62) Division of application No. 12/016,202, filed on Jan. 17, 2008, now Pat. No. 7,915,514.

(51) Int. Cl.
*G10H 7/00* (2006.01)

(52) U.S. Cl. ..... 84/645

(58) Field of Classification Search ..... 84/645
See application file for complete search history.

(56) References Cited

U.S. PATENT DOCUMENTS

| | | | |
|---|---|---|---|
| 6,958,441 | B2 | 10/2005 | Georges et al. |
| 7,174,510 | B2 | 2/2007 | Salter |
| 7,709,723 | B2 | 5/2010 | Pachet et al. |
| 2002/0194984 | A1 | 12/2002 | Pachet |
| 2003/0151628 | A1 | 8/2003 | Salter |
| 2006/0180008 | A1 | 8/2006 | Negoescu et al. |
| 2006/0252503 | A1 | 11/2006 | Salter |
| 2007/0256542 | A1 | 11/2007 | Tamura et al. |

*Primary Examiner* — Jianchun Qin

(74) *Attorney, Agent, or Firm* — Christie, Parker & Hale, LLP

(57) ABSTRACT

An advanced MIDI/audio processing system with virtual key-switches. The virtual key-switches are mapped to different musical concepts. As a user presses a key-switch in real time with the playing of musical notes, the musical concept mapped to the key-switch that was pressed is applied. The instrument then switches to a new playing state based on the particular musical concept that was applied. Furthermore, the system is configured to provide a smooth transition between dynamic levels when applying crescendo or diminuendo effects via a modulation wheel. The system also configured to provide enhanced cycling of alternate samples by providing an individual alternate cycle for each note of each articulation in each dynamic level. Furthermore, the system is configured to allow a user to store and recall specific cycle positions, and override an existing cycle to choose a specific alternate sample for a specific note.

5 Claims, 14 Drawing Sheets

Virtual Key-Switches Master-Map for all the instruments of the "Broadway Saxophone and Woodwinds" series

| | Primary Functionality | With Shift-1 | With Shift-2 | With Shift-1 + Shift-2 | With Option-1 | With Option-2 | With Option 1+2 |
|---|---|---|---|---|---|---|---|
| C1 24 | Repetition - ("Virtual Sustain Pedal") | ---------- | ---------- | ---------- | ---------- | ---------- | ---------- |
| C#1 25 | Staccatissimo + Option-1 | ---------- | ---------- | ---------- | ---------- | ---------- | ---------- |
| D1 26 | Smear into note / Smear Legato | Marcato + Smear FP | Smear down and back | ---------- | Rip up into short note (Staccato) | Rip down into note (sustain) | Smear into note (slow) |
| D#1 27 | Staccato + Option-2 | ---------- | ---------- | ---------- | ---------- | ---------- | ---------- |
| E1 28 | Flutter/growl OFF | ---------- | ---------- | ---------- | ---------- | ---------- | ---------- |
| F1 29 | Growl ON | Flutter ON | ---------- | ---------- | ---------- | ---------- | ---------- |
| F#1 30 | Fall Down (fast) | Fall Up Slow | ---------- | ---------- | Glide Down | Fall Up | Fall Down (Slow) |
| G1 31 | Soft Attack / Slow Release | ---------- | ---------- | ---------- | ---------- | ---------- | ---------- |
| G#1 32 | Sforzzando | Marcato + "Dirty" vibrato | Marcato (FP) + mild vibrato | Clap-bend | Sforzzando + Crescendo (fast) | Sforzzando + Crescendo (Slow) | ---------- |
| A1 33 | SHIFT-1 | ---------- | ---------- | ---------- | ---------- | ---------- | ---------- |
| A#1 34 | Grace Note | Strong vibrato | | | | | ---------- |
| B1 35 | SHIFT-2 | ---------- | ---------- | ---------- | ---------- | ---------- | ---------- |
| C2 36 | Progressive Vibrato | Progressive Vibrato (Active VKS) | No Vibrato | No Vibrato (Active VKS) | ---------- | ---------- | ---------- |
| C#2 37 | Alternate Fingering | | | | | | |
| D2 38 | Deep Vibrato | Deep Vibrato (Active VKS) | Normal Vibrato | Normal Vibrato (Active VKS) | | | |
| D#2 39 | SHIFT-3 | | | | | | |
| E2 40 | Legato (Saxophones) | | | | | | |
| F2 41 | Detache (Saxophones) | | | | | | |

FIG. 5A

Virtual Key-Switches Master-Map for Broadway Trumpets Alpha Version

| | Primary Functionality | With Shift-1 | With Shift-2 | With Shift-1 + Shift-2 | With Option-1 | With Option-2 | With Option 1+2 |
|---|---|---|---|---|---|---|---|
| C1 24 | Repetition - ("Virtual Sustain Pedal") | ---------- | ---------- | ---------- | ---------- | ---------- | ---------- |
| C#1 25 | Staccatissimo + Option-1 | ---------- | ---------- | ---------- | ---------- | ---------- | ---------- |
| D1 26 | Smear into note / Smear Legato | ---------- | Smear down and back | ---------- | Rip up into short note (Staccato) | Rip down into note (sustain) | Rip up into note (sustain) |
| D#1 27 | Staccato + Option-2 | ---------- | ---------- | ---------- | ---------- | ---------- | ---------- |
| E1 28 | Flutter/growl OFF | ---------- | ---------- | ---------- | ---------- | ---------- | ---------- |
| F1 29 | Flutter ON | Growl ON | ---------- | ---------- | ---------- | ---------- | ---------- |
| F#1 30 | Fall Down (fast) | Fall Up (Slow) | | ---------- | Glide Down | Fall Up | Fall Down (Slow) |
| G1 31 | Soft Attack / Slow Release / Fast Attack in flutter (Brass Only) | ---------- | ---------- | ---------- | ---------- | ---------- | ---------- |
| G#1 32 | Sforzzando | Marcato + "Dirty" vibrato | Marcato (FP) + mild vibrato | Clap-bend | Sforzzando + Crescendo (fast) | Sforzzando + Crescendo (Slow) | ---------- |
| A1 33 | SHIFT-1 | ---------- | ---------- | ---------- | ---------- | ---------- | ---------- |
| A#1 34 | | Shakes (fast) | | Shakes (slow) | | | ---------- |
| B1 35 | SHIFT-2 | ---------- | ---------- | ---------- | ---------- | ---------- | ---------- |
| C2 36 | Progressive Vibrato | | No Vibrato | | ---------- | ---------- | ---------- |
| C#2 37 | Rip Portamento | | | | | | |
| D2 38 | Deep Vibrato | | Normal Vibrato | | | | |
| D#2 39 | Chromatic Runs + SHIFT-3 | | | | | | |
| E2 40 | Plunger OFF | | | | | | |
| F2 41 | Plunger ON | | | | | | |

FIG. 5B

ADVANCED MIDI AND AUDIO PROCESSING SYSTEM AND METHOD

CROSS REFERENCE TO RELATED APPLICATION(S)

This application is a divisional application of U.S. application Ser. No. 12/016,202 (now U.S. Pat. No. 7,915,514) filed Jan. 17, 2008, the content of which is incorporated herein by reference.

FIELD OF THE INVENTION

The present invention relates generally to samplers and MIDI/audio processors, and more specifically, to an advanced MIDI and audio processing system for intuitive, real-time switching of the playing state of an instrument via enhanced key-switches.

BACKGROUND OF THE INVENTION

Key switching is a feature included in most software samplers and sample players currently available on the market. It enables switching between different patches of audio samples by designating a limited amount of MIDI (Musical Instrument Digital Interface) keys on a music MIDI keyboard as key-switches. These keys become unplayable as musical notes. Instead, each key-switch generally represents a single sample patch and a note played after pressing a key-switch triggers the corresponding sample from the selected patch.

This prior art key-switching mechanism has several drawbacks. First, in order to support a large number of patches, a large number of key-switches is required. The larger the number of key-switches, the harder it is to locate the proper patch for a chosen articulation. Furthermore, the larger number of key-switches, the more they take over the MIDI keyboard and over-limit its playable range.

Second, in the prior art key-switching mechanism, the behavior of all key-switches is generally the same. Specifically, after choosing a patch by pressing a particular key-switch, all notes played thereafter trigger a note from the selected patch. Returning to the previous patch generally requires a separate pressing of a corresponding key-switch. This makes it very difficult, and sometimes nearly impossible, to switch back and forth between different patches quickly enough for performing music in real-time situations.

Third, it is often desirable to switch between patches in a way that will affect a note that has already been played. The existing key-switching mechanism makes no provisions for this.

One MIDI processing tool provided by the prior art allows the automatic switching to the proper patch in the sample player with a corresponding pre-recorded note transition (e.g. a legato note-transition) based on analysis of MIDI notes played by the user. In this regard, key-switch information is generated which is sent to the sample player and which remaps the MIDI note events to match the actual note-transition samples which are mapped all over the virtual MIDI keyboard (128 virtual keys) of the sample player, and by that, minimizing the amount of different key-switches that are required for that operation.

One drawback with this MIDI processing tool is the significant limitation in the number and types of articulations and playing techniques that may be switched to in real time. For example, the MIDI processing tool enables up to two interchangeable playing techniques switchable by using a modulation wheel controller (e.g. switching between legato and portamento). However, this MIDI processing tool does not allow switching between legato playing and other articulations and playing techniques such as, for example, non-legato playing patches (e.g. staccato, tremolo, and the like), in real time. If such switching is desired, multiple separate "instruments" are loaded for different sets of musical articulations of a single instrument, making the access to different playing techniques a matter of offline MIDI editing rather than a real-time intuitive process.

Another drawback with this MIDI processing tool is that it uses key-switches for patch selection which limits the number of different pre-recorded note-transitions that may be accessed by the tool. Since MIDI controllers, as well as MIDI notes, may have a value in the range 0-127, each patch in the sampler contains 128 virtual keys that may be mapped to pre-recorded samples. Key-switches use virtual keys in the sampler for the sake of patch selection, therefore leaving less virtual keys available for mapping regular notes. This poses a serious limitation on the number of key-switches that may be assigned for an instrument, and consequently, the number of different patches that may be accessed. Therefore, this MIDI controller generally supports intervals of up to one octave up and down from each note, and with no more than two note-transition styles accessible via the modulation wheel controller.

Accordingly, what is desired is a system and method that enables intuitive, real-time access to a large number of different patches of sound samples based on musical context and using smaller, more manageable amount of actual physical controlling keys, providing an easy and intuitive workflow for generating complex MIDI information for more realistic sounding MIDI music productions.

Repetition tools also exist in the prior art which provide different mechanisms for performing repetitions. According to a first mechanism, repeated notes are pre-recorded with a fixed number of repetitions and a fixed tempo. In order to adjust the pre-recorded repetition performance to a desired tempo, a user may play in a slightly faster tempo than the tempo in the original recording. When this happens, the repetition tool skips to a next repeated note in the recording as the user plays the next note earlier than the original time it was supposed to be played based on the original recording. The repetition tool also enables the user to define a different number of repetitions (smaller number), by defining which of the pre-recorded repeated notes will not be played (will be skipped). However, the number of repeated notes are determined in advance and may not be changed in real-time.

According to a second mechanism, repetitions are performed by pressing a MIDI trigger which behaves like a key-switch before releasing the note that is to be repeated, and repeatedly pressing the MIDI trigger every time before playing the next repeated note. As a consequence, the MIDI trigger must be pressed every single time before every repetition.

One drawback with the first mechanism of performing repetition is the lack of flexibility and the need to pre-program the tool to match different musical needs. One drawback with the second mechanism of performing repetition that in many cases, notes are to be repeated rapidly. Thus, pressing the MIDI trigger before every repetition is in most cases not feasible. The prior art addresses this problem by providing offline MIDI editing which, once again, compromises the real-time live performance. Accordingly, what is desired is an improved mechanism for performing repetitions which does not require pre-recording of the repetitions and does not requires a MIDI trigger to be pressed before each repetition.

The prior art uses the modulation wheel for creating crescendo/diminuendo effects by cross-fading different pre-recorded dynamic levels of a sampled instrument. However, the use of the modulation wheel introduces two deficiencies which are not solved by prior art systems. A first deficiency is that an initial dynamic level of a played sample is determined by velocity data attached to a "note-on" event from the MIDI keyboard, while the modulation wheel starts sending MIDI controller values when the wheel is first moved by the user. Since the value generated by the velocity is generally never the same as the first value generated by the modulation wheel, a common side-effect is an abrupt change of dynamics due to the difference between the velocity value and the value generated by the modulation wheel, which sounds unnatural and typically does not represent the musical intention of the user.

A second drawback is the effect of cross-fading, especially with solo instruments. Cross-fading between two different samples creates an audible overlapping between the dynamic layers, which means that at some point both layers may be heard at the same time. With samples of large sections, such as a symphonic string section, this kind of overlapping sound generally does not pose a problem. However, overlapping two samples of a solo instrument creates an unconvincing result, since during the cross-fading one hears two of the same instrument instead of one. This effect is caused both by the difference in timbre between the two samples, and because of phase synchronization issues. Accordingly, what is desired is a system and method for smooth dynamic transitions between different dynamic layers while at the same time allowing a user to fully control the initial dynamic level by velocity control.

The prior art also provides arpeggiators not only in consumer-level keyboard synthesizers, but also as step-time (offline editing) basic sequencer which enables playing simple MIDI patterns based on real-time input from a MIDI keyboard, by either choosing a base note, a chord or any combination of notes. What is desired is to enhance the standard arpeggiator functionality provided by standard arpeggiators with functionality that controls real-time switching between different MIDI patterns and variations.

While all of the above mentioned art relate to multi-sample libraries (collections of pre-recorded single note performances), pre-recorded audio performance loops also exist, but lack the flexibility of playing custom made melodies, rhythms, or harmonies. Pre-recorded audio performance loops instead use the pre-recorded performance of single or multiple instruments, in most cases, playing repetitive patterns. This mechanism is widely used for drum patterns (drum loops), brass pre-recorded phrases, and guitar loops. One of the advantages of using pre-recorded audio performance loops and phrases is the highly realistic sounding performance it provides since a real performance of a live musician is used in generating the loops.

Recently various tools have been created in order to adjust the tempo and pitch of those pre-recorded loops and phrases. However, manipulation of those patterns is still limited.

Another problem is the lack of consistency in timbre when interweaving between pre-recorded audio performance loops and phrases and playing more specific performance using multi-sample based instruments. This is because the different loops and phrases generally use different recording techniques and are often produced separately and by different companies. Prerecorded loops and phrases commit the user to performances of the entire melody lines, which does not allow users to change these and build their own melodies.

The prior art also provides software samplers that attempt to address the "machine-gun-effect" which is created by the repetition of the same sample several consecutive times by providing several alternate recorded versions of the same sample to be either randomly chosen or cycled in real-time. Thus, if the user repeats the same note several consecutive times, the software does not repeat the same sample several times, but cycles between different samples of that note, which helps improve realism. However, the mechanism used by currently available software samplers to cycle between the various available alternate samples generally requires two things. First, it generally requires a constant number of alternate recordings for each note in the program. This poses a problem when the usage of different number of alternates for different notes in the program is desired. In order to achieve a different number of alternates for different notes in the same program, a global cycle is provided which is as long as the lowest common multiple of the various numbers of alternates for the different notes, and each cycle that is smaller than the global size is duplicated the proper number of times based on the length of the global cycle. For example, if some notes have three alternates and others have four alternates, a global cycle of 12 alternates is created while the cycle of the notes with three alternates are duplicated four times and the cycle of the notes with four alternates are duplicated three times. When mixing less compatible numbers, such, as, for example, if adding a cycle of five alternates to the above example, a global cycle of 30 alternates is created. One of the main deficiencies of this solution is that the additional instances of samples (sample duplicates) and more complex structure of the program significantly increases the memory consumption and loading time when loading such a program onto the sample player. As a result, a less number of instruments may be loaded at the same time onto each computer.

A second requirement of the prior art mechanism to cycle between various available alternate samples is that each note played in the program of the instrument triggers a next step in the alternate-cycle. This creates a problem in cases where the user plays a repetitive musical phrase that includes the same amount of notes as the number of alternates in the cycle. In such a case, the same sample will always be triggered within that repetitive musical phrase. For example, if there is only one additional version of a note (two alternates), and the user plays a two-note trill, the "machine-gun-effect" will appear in spite of using alternates.

Accordingly, what is desired is a system and method for improved alternates cycling that addresses these issues.

SUMMARY OF THE INVENTION

According to one embodiment, the present invention is directed to a method for real-time switching between different playing states. The method includes: providing a plurality of key-switches, wherein each of the key-switches is mapped to one or more musical concepts; playing a plurality of musical notes; receiving user actuation of a key-switch selected from the plurality of key-switches in real time with the playing of the musical notes; applying the musical concept mapped to the actuated key-switch to one or more of the musical notes; and switching to a corresponding playing state based on the applying of the musical concept to the one or more of the musical notes.

The different musical concepts may include different styles of note transitions, different articulations, different playing techniques, and the like.

According to one embodiment of the invention, the different articulations include legato and non-legato articulations, and the switching includes switching from a legato playing state to a non-legato playing state based on the actuation of the key-switch mapped to the non-legato articulation.

According to one embodiment of the invention, the one or more of the musical notes is pressed before the key-switch applying the mapped musical concept to the one or more of the musical notes, is pressed.

According to one embodiment of the invention, the method includes switching to the corresponding playing state and maintaining the playing state while the actuated key-switch remains pressed; and reverting to a previous playing state in response to releasing of the key-switch.

According to one embodiment of the invention, pressing a first key-switch concurrently or before pressing a second key-switch applies a different musical concept to the one or more of the musical notes than the musical concept applied by pressing the first key-switch alone.

According to one embodiment of the invention, actuation of the one of the plurality of key-switches sustains a prior note until a new note is triggered.

According to one embodiment of the invention, actuation of the one of the plurality of key-switches forces a particular bow direction for bowed string instruments.

According to another embodiment, the present invention is directed to a method for processing music data including a playable note and one or more key-switch notes. The method includes: distinguishing the playable note from the key-switch notes, the playable note and key-switch notes being associated with an initial triggering order; creating a buffer for the playable note and the one or more key-switch notes; reordering the notes in the buffer; and triggering the notes in the buffer according to a second triggering order.

According to one embodiment of the invention, the buffer corrects accidental triggering of the one or more key-switch notes in an inconsistent order.

According to another embodiment, the present invention is directed to a method for changing the dynamic level of a musical note and switching between separately sampled dynamic layers. The method includes: receiving the musical note with a velocity value; detecting user actuation of a controller device for changing the dynamic level of the musical note; receiving a dynamic level value from the controller device in response to the user actuation; morphing the velocity value and dynamic level value for generating a morphed value, wherein the morphing includes filling in gaps in the dynamic level value for smoothing the level change; and outputting the morphed value as the current dynamic level for the played note.

According to one embodiment of the invention, the method includes defining two thresholds between any two dynamic layers, the two thresholds including a low threshold and a high threshold; cross-fading to a next dynamic layer responsive to an upwards movement of the controller device if the current dynamic level crosses the high threshold between the current dynamic layer and the next dynamic layer; and cross-fading to a previous dynamic layer responsive to a downwards movement of the controller device if the current dynamic level crosses the low threshold between the current dynamic layer and the previous dynamic layer.

According to one embodiment of the invention, the two thresholds are aimed to prevent accidental dynamic layer changes due to wobbling of the controller device.

According to one embodiment of the invention, the method includes determining whether at least one threshold associated with a current dynamic layer has been crossed by the current dynamic level; triggering an audio sample associated with a next sampled dynamic layer in response to the determination; and performing a cross-fade of a predetermined length from the current dynamic layer to the next dynamic layer.

According to one embodiment of the invention, the method includes morphing a current audio sample associated with the current dynamic layer with the audio sample associated with the next dynamic layer.

According to one embodiment of the invention, the morphing includes temporarily adjusting an amplitude level of the audio sample associated with the next dynamic layer to an amplitude level of the current audio sample.

According to one embodiment of the invention, the morphing includes temporarily adjusting a timbre of the audio sample associated with the next dynamic layer to a timbre of the current audio sample.

According to another embodiment, the present invention is directed to a method for changing dynamic layers of a musical note. The method includes providing a plurality of key-switch notes, each key-switch note associated with a particular transition speed; receiving actuation of a musical note played with a first velocity; receiving actuation of one of the plurality of key-switch notes played with a second velocity; and triggering an audio sample providing a transition of dynamics for the musical note from a sampled dynamic level containing the first velocity to a sampled dynamic level containing the second velocity according to the transition speed associated with the actuated one of the plurality of key-switch notes.

According to another embodiment, the present invention is directed to a method for activating alternate audio samples recorded for a particular musical note. The method includes providing a first plurality of alternate audio samples for a first musical note, and a second plurality of alternate audio samples for a second musical note; cycling through the first plurality of alternate audio samples for playing the first musical note independently from the cycling through the second plurality of alternate audio samples for playing the second musical note; and triggering one of the first plurality of alternate audio samples and one of the second plurality of alternate audio samples based on respective positions of the corresponding cycles.

According to one embodiment of the invention, the providing of the first and second plurality of alternate audio samples for respectively the first and second musical notes includes providing alternate audio samples for each of a plurality of articulations of respectively the first and second musical notes.

According to one embodiment of the invention, the providing of the first and second plurality of alternate audio samples for respectively the first and second musical notes includes providing alternate audio samples for each of a plurality of dynamic layers of respectively the first and second musical notes.

According to another embodiment, the present invention is directed to a method for saving and recalling cycle positions associated with a plurality of cycles of alternate audio samples for a plurality of instruments. The method includes: playing a musical piece; creating a snapshot of a current position of the plurality of cycles; assigning a value to the created snapshot; storing the created snapshot in association with the assigned value; and retrieving the snapshot responsive to a pre-defined note event, wherein a velocity value of the pre-defined note event identifies the assigned value of the snapshot.

According to one embodiment of the invention, the method further includes identifying a note in a performance; assigning a user selected alternate sample to the identified note; and triggering the user selected alternate sample for the note instead of an alternate sample selected based on a cycling of different alternate samples available for the identified note.

These and other features, aspects and advantages of the present invention will be more fully understood when considered with respect to the following detailed description, appended claims, and accompanying drawings. Of course, the actual scope of the invention is defined by the appended claims.

BRIEF DESCRIPTION OF THE DRAWINGS

FIGS. 5A-5B are functional diagrams illustrating the mapping of various virtual key-switches to their associated musical concepts;

DETAILED DESCRIPTION

In general terms, embodiments of the present invention provide MIDI functionality for real-time switching to different playing states of an instrument and retrieving corresponding audio samples for that playing state in a fast and intuitive manner, as well as audio functionality for producing realistic sounds which more accurately represents the musical intentions of a user. In this regard, a MIDI and audio processing system is provided with various key-switches which, unlike prior art key-switches, have enhanced functionality. Such enhanced key-switches are also referred to as virtual key-switches.

According to one embodiment of the invention, the virtual key-switches are mapped to different musical concepts, such as, for example, different articulations (e.g. legato, staccato, staccatissimo, falls, rips, shakes, flutter-tounguing, plunger, grace notes, smearing effect, etc.), playing techniques, dynamic transition speeds, musical styles, and the like. As a user presses a key-switch in real time with the playing of the musical notes, the system is configured to apply the musical concept mapped to the key-switch that was pressed, to one or more musical notes that are pressed after, or, depending on the type of key-switch, even before the key-switch was pressed. The instrument then switches to a new playing state based on the particular musical concept that has been applied.

According to one embodiment of the invention, the virtual key-switches use a small amount of physical keys on the keyboard. In one example, over 16,000 different patches (128*128) are accessed with only 18 physical keys, for ergonomic reasons.

In addition to virtual key-switches, the advanced MIDI and audio processing system is configured to provide a smooth transition between dynamic levels when applying crescendo or diminuendo effects via a modulation wheel. The system also configured to provide enhanced cycling of alternate samples by providing an individual alternate cycle for each note of each articulation in each dynamic level. Furthermore, the system is configured to allow a user to store and recall specific cycle positions, and override an existing cycle to choose a specific alternate sample for a specific note. Embodiments of the present invention also allow a user to create their own melodies without sacrificing the realism they offer.

Figure 1:
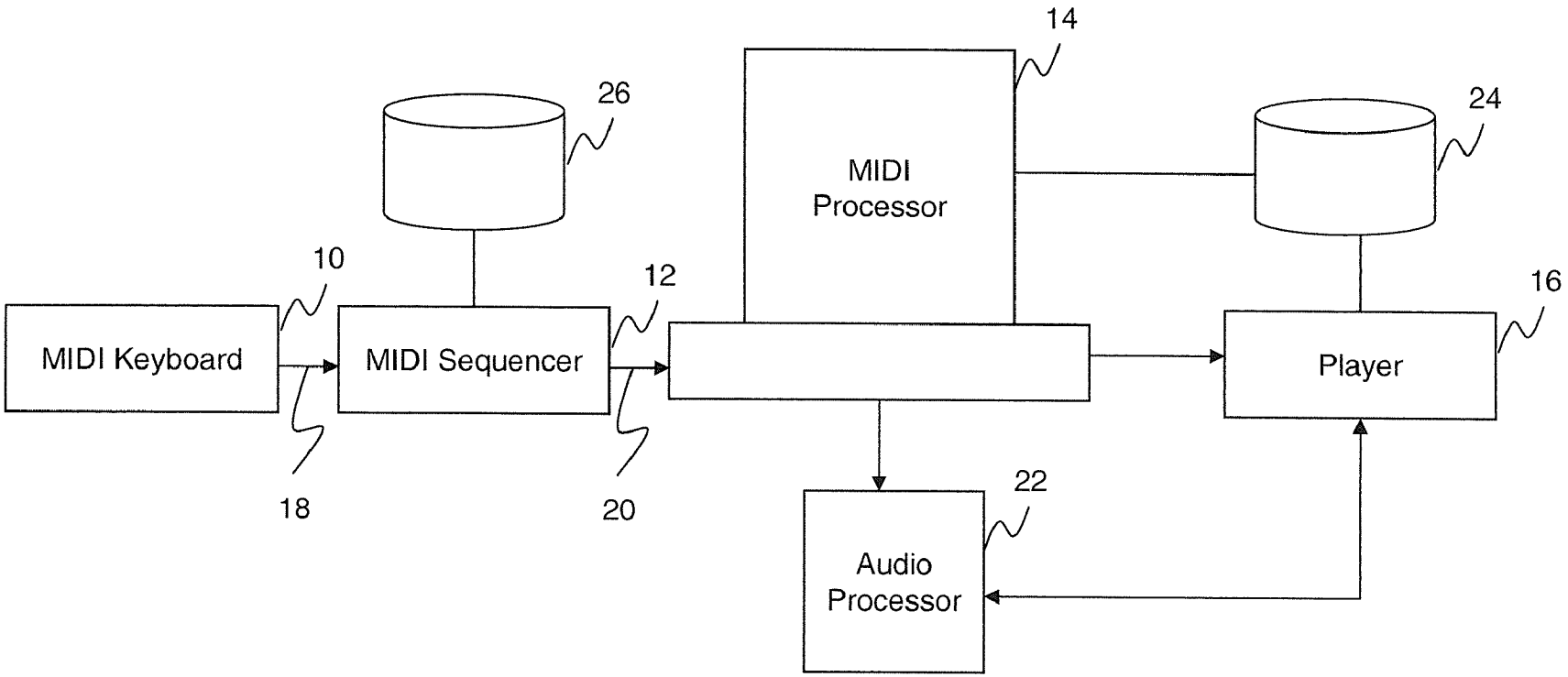
FIG. 1 is a block diagram of an advanced MIDI and audio processing system according to one embodiment of the invention.

FIG. 1 is a block diagram of an advanced MIDI and audio processing system according to one embodiment of the invention. The system includes a MIDI keyboard 10 coupled to a MIDI sequencer 12 over a cable 18, such as, for example, a USB cable, MIDI cable, or any other wired or wireless connection known in the art. According to one embodiment of the invention, the MIDI keyboard 10 includes piano-style keys where certain keys are designated for generating key-switch triggers (also referred to as virtual key-switches), and other keys are designated for generating playable notes. The MIDI keyboard 10 further includes a modulation wheel, volume pedal, and/or other MIDI controller for controlling the dynamic level of a note or set of notes, such as, for example, for applying crescendo or diminuendo effects to the notes.

The MIDI sequencer 12 receives MIDI information generated by the MIDI keyboard 10 for recording and editing, and outputs MIDI data to the MIDI processor 14. In this regard, the MIDI sequencer 12 includes various recording and editing tools conventional in the art. For example, the MIDI sequencer 12 may include a note editing tool that allows a user to remove, edit, or add MIDI notes of a musical piece, and assign different values to such notes, such as, for example, a pitch, velocity, and the like. The MIDI sequencer 12 also provides different user controls for storing different snapshots of the positions of different alternate sample cycles for available MIDI instruments. A data store 26 coupled to the MIDI sequencer 12 stores the recordings generated by the MIDI sequencer.

According to one embodiment of the invention, the MIDI processor 14 is programmed to analyze incoming MIDI data from the sequencer and choose appropriate audio samples for generating MIDI output messages corresponding to the selected samples to a sample player (audio engine) 16. According to an alternative embodiment of the invention, the MIDI processor 14 operates in a stand-alone mode without the MIDI sequencer 12. According to this embodiment, the MIDI keyboard 10 is coupled directly to the MIDI processor 14 via the cable 18, and the MIDI processor receives incoming MIDI data directly from the MIDI keyboard.

The sample player 16 is coupled to the MIDI processor 14 over a second virtual MIDI cable 22. The sample player receives the MIDI output messages generated by the MIDI processor and provides corresponding audio playback in response. The sample player may be an audio engine marketed as the HALion Player by Steinberg Media GmbH.

According to one embodiment of the invention, the system also includes an audio processor 22 configured to perform various audio processing functionalities including morphing between several prerecorded dynamics in order to create MIDI modulation-wheel-controlled crescendo and diminuendo effects. According to one embodiment of the invention, the audio processor 22 is an audio plug-in which may be hosted, for example, by the MIDI sequencer 12. A person of skill in the art should appreciate that this and other components of the system may be combined or hosted in various different devices. For example, the MIDI and/or audio processing features of the MIDI processor 14 and/or audio processor 12 may be integrated into the player 16 or other component of the system as will be appreciated by a person of skill in the art.

The MIDI processor 14 and player 16 are coupled to a data storage device 24 storing different patches of audio samples which have been recorded, for example, from live performances of different instruments. For example, different patches of audio samples may be stored for different musical styles and/or playing techniques including different articulations, dynamic levels, and the like. Although FIG. 1 illustrates a single data storage device 24 for both the MIDI processor 14 and player 16, a person of skill in the art should recognize that the MIDI processor and player may each have its own dedicated data storage device.

Figure 2:
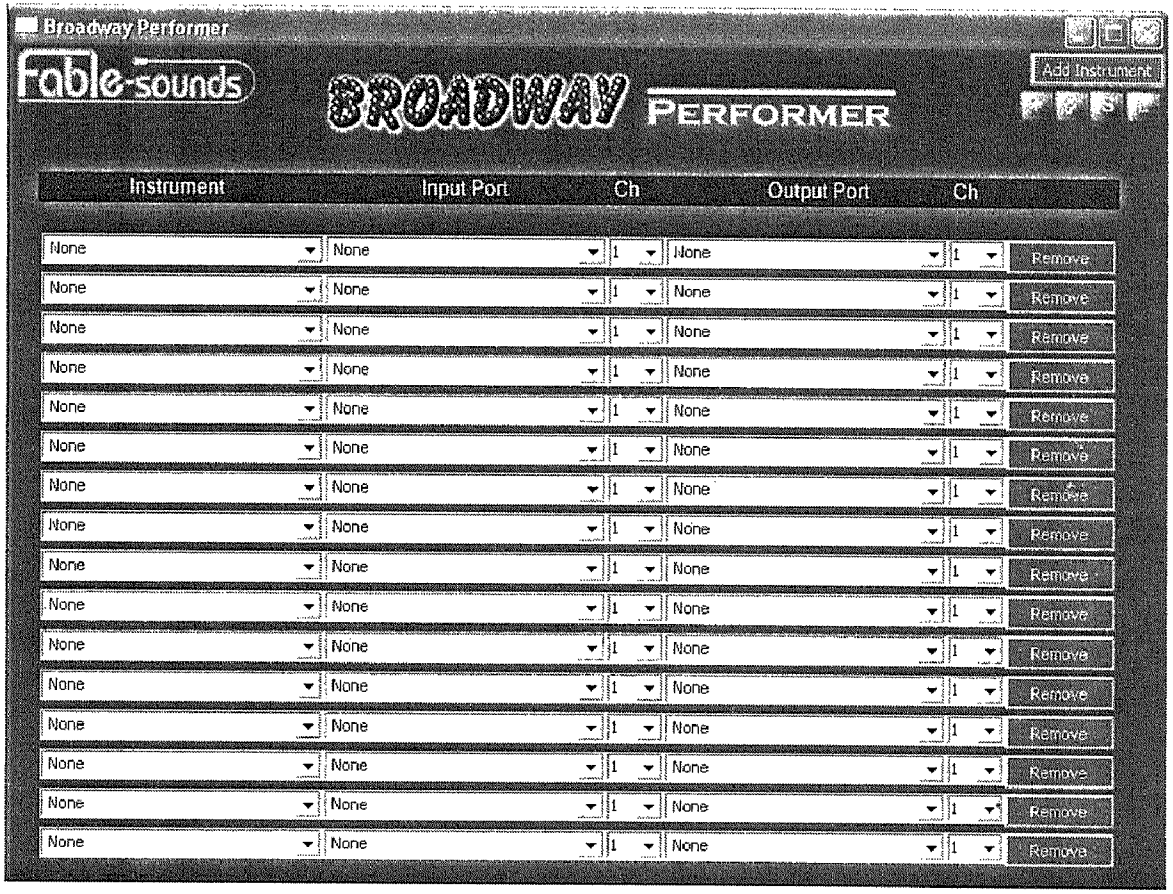
FIG. 2 is a photographic image of a screen shot of a graphical user interface provided by a MIDI processor according to one embodiment of the invention.

FIG. 2 is a photographic image of a screen shot of a graphical user interface provided by the MIDI processor 14 according to one embodiment of the invention. The graphical user interface allows the loading of various instruments to the processor, and further allows the user to designate the appropriate MIDI input ports, channels, and output ports depending on whether the MIDI processor is functioning in a standalone mode or with a sequencer. The graphical user interface further provides an icon for invoking a virtual key-switch status monitor as is described in further detail below.

Figure 3:
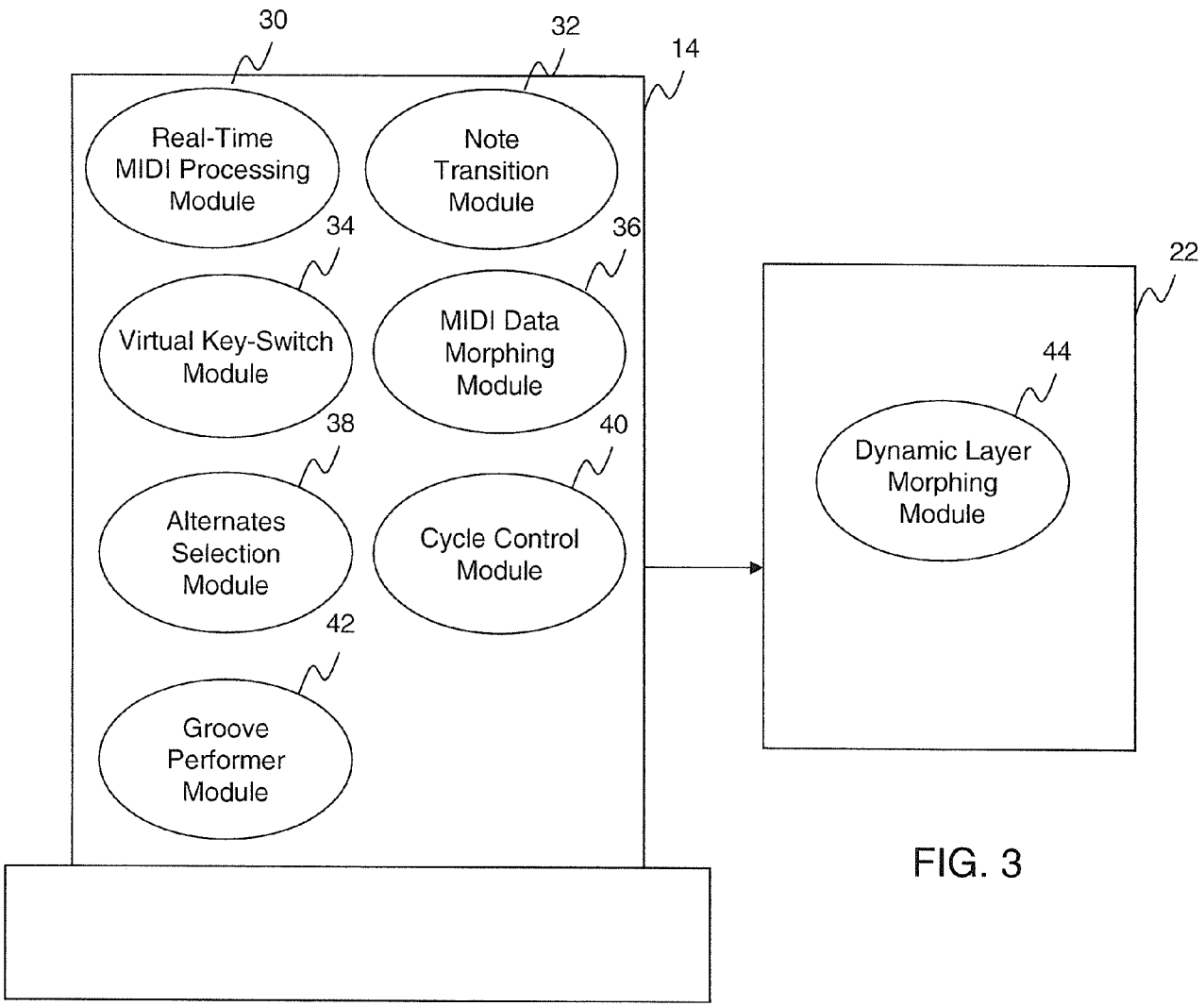
FIG. 3 is a block diagram of various modules executed by MIDI and audio processors according to one embodiment of the invention.

FIG. 3 is a block diagram of various modules executed by the MIDI and audio processors 14, 12 according to one embodiment of the invention. The modules may be software modules containing computer program instructions which are stored in memory and executed by the MIDI or audio processors 14, 12 to achieve different MIDI and audio processing functionality. According to one embodiment of the invention, the MIDI processor 14 is configured with a real-time MIDI processing module 30, note transition module 32, virtual key-switch module 34, MIDI data morphing module 36, alternates selection module 38, alternates cycle control module 40, and MIDI pattern based groove performer module 42, which together provide MIDI functionality for the system. According to one embodiment of the invention, the audio processor 22 is configured with a dynamic layer morphing module 44 which provides audio functionality for the system. A person of skill in the art should recognize that the functionality of one or more of the modules may be combined into a single module, or the functionality of one or more of the modules further separated into additional modules or sub-modules. A person of skill in the art should also recognize that the modules may be implemented via software, or any combination of software, firmware, and/or hardware.

According to one embodiment of the invention, the real time MIDI processing module 30 is configured to process incoming MIDI data and distinguish between playable notes and virtual key switches according to a predefined key-switch definition and a playable range of the relevant instrument. The MIDI processing module is further configured to recognize the types of virtual key-switches that have been pressed, create a performance buffer, and organize the virtual key-switches and playable notes in the correct processing order while managing the various MIDI processing stages of the MIDI data. In this regard, the real time MIDI processing module 30 is configured with an error correction component that recognizes and corrects accidental triggering of certain virtual key-switches within the buffer window.

According to one embodiment of the invention, the note transition module 32 is configured to analyze the note transitions played by the user and accordingly generate a combination of MIDI controller and MIDI note information to be sent to the sample player 16 in order to choose a patch that includes a prerecorded note-transition which matches the one played by the user.

According to one embodiment of the invention, the virtual key-switch module 34 is configured with virtual key-switches which are enhancements of traditional key switches for selecting different audio patches. Instead of functioning as a simple patch selector, the virtual key-switches enable the user to access a significant amount of sample patches with a small amount of physical controlling keys, in a significantly more intuitive manner than with prior art key-switches. The virtual key-switch module 34 is further configured with special virtual key-switches for changing dynamic levels on the fly with pre-recorded transitions between different dynamics. A virtual key-switch is also provided to allow for note repetitions via a virtual sustain pedal. The virtual key-switch module 34 is further configured to provide a virtual key-switch status monitor which offers the user a graphic representation of the current playing state of the instrument.

According to one embodiment of the invention, the MIDI data morphing module 36 is configured to avoid an abrupt change of dynamics due to the user pressing a note with an initial MIDI velocity and then using the modulation wheel (or other MIDI controller) for diminuendo/crescendo effects. In this regard, the MIDI data morphing module 36 takes the MIDI velocity value of a currently played note and morphs it into a newly generated modulation wheel value thereby creating a smooth transition in dynamics.

According to one embodiment of the invention, the dynamic layer morphing module 44 is configured to create a smooth transition in dynamics when going from a current sample of prerecorded dynamics to a new sample of prerecorded dynamics via control of the MIDI modulation wheel. In this regard, the dynamic layer morphing module 44 morphs between the two samples by modifying the timbre of the two samples to help them match each other, and by matching the levels of amplitude of the two samples which are being cross-faded.

According to one embodiment of the invention, the MIDI pattern based groove performer module 42 uses a combination of upper-level virtual key-switches to choose between various prerecorded MIDI patterns (using MIDI files), which already include the "standard-level" virtual key-switching information, and (for tuned instruments) applies MIDI notes played by the user to the selected pattern, thereby generating complex MIDI output to be played by the sample player. This generated output includes various MIDI controller and MIDI note events, which are potentially impossible to play in real-time without using this tool.

According to one embodiment of the invention, an alternates selection module 38 provides realism during repetitions by improving the quality of the cycling used for activating alternate samples. According to one embodiment of the invention, alternates are created for each dynamic layer of each articulation of each note in the program (i.e. instrument), and the alternates are cycled independently of one another.

According to one embodiment of the invention, an alternates cycle control module 40 is configured to store and recall specific cycle positions in response to one or more user commands, and override an existing cycle to choose a specific alternate sample, also in response to one or more user commands.

Figure 4:
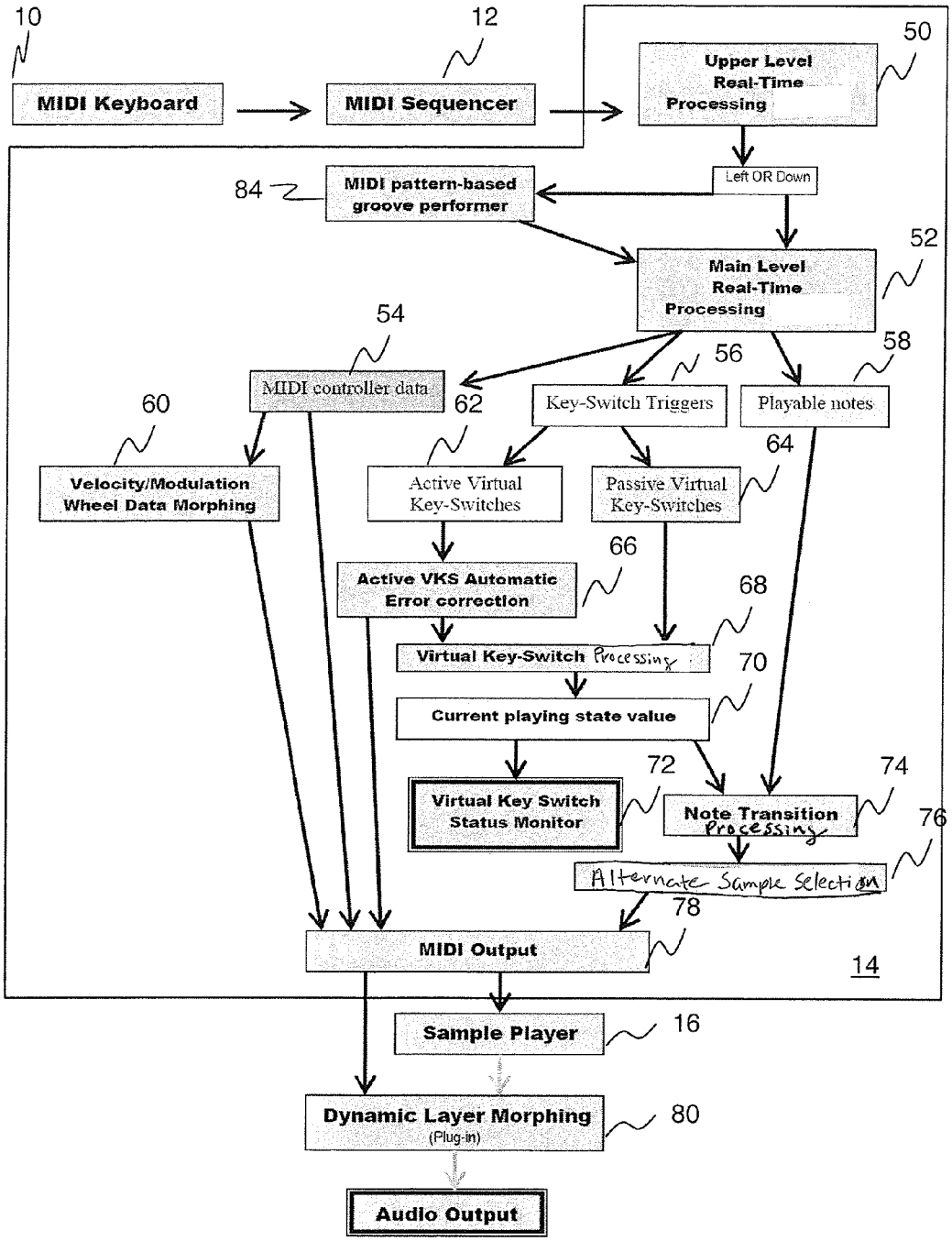
FIG. 4 is a flow diagram of an overall MIDI and audio processing operation according to one embodiment of the invention.

FIG. 4 is a flow diagram of an overall MIDI and audio processing operation according to one embodiment of the invention. MIDI data is received by the real time MIDI processing module 30 and put in a buffer. The MIDI processing module 30 processes the MIDI controller data in the order in which it is received, and before any MIDI note data is processed.

The MIDI processing module 30 invokes upper level real-time processing 50 for determining if certain virtual key-switches (e.g. the upper level key-switches) have been activated by the user. According to one embodiment of the invention, certain upper level key-switches may be activated to select between various available performance-patterns, and/or to activate/deactivate a MIDI pattern-based groove performer 84. If the MIDI pattern-based groove performer has been activated, the groove performer module 42 identifies a MIDI pattern associated with the selected virtual key-switch, retrieves the key-switching information contained in the MIDI pattern, and forwards the retrieved key-switching information for further processing.

The MIDI processing module 30 receives the MIDI data and in step 52, proceeds to sort and separate the MIDI notes data into, for example, two groups: a playable notes group 58 including notes within the playable range of the instrument that is invoked, and a key-switch triggers group 56 including key-switch triggers. In this regard, certain keys in the physical MIDI keyboard, such as, for example, keys on the low end of the MIDI keyboard, are designated as special key-switches. The MIDI processing module also recognizes and separates MIDI controller data 54 generated, for example, the modulation wheel.

According to one embodiment of the invention, key-switch triggers are handled before the playable notes. If any of the MIDI notes is not defined as either a playable note or key-switch trigger, it is disregarded. According to one embodiment of the invention, key-switch triggers are handled according to a predetermined order of priority scale. Also, according to one embodiment, playable notes are handled only after the key-switch triggers are fully processed, and that, in the order in which they were received (e.g. according to their timestamps).

MIDI notes recognized as key-switch-triggers are sent to the virtual key-switch module 32, ordered according to their timestamps, for virtual-key switch processing in step 68. In response to such processing, the virtual key-switch module activates (or releases) the virtual key-switches according to their type (e.g. active 62 or passive 64). Before doing so, however, the active virtual key-switches 62 are first processed for error correction in step 66.

Figure 8:
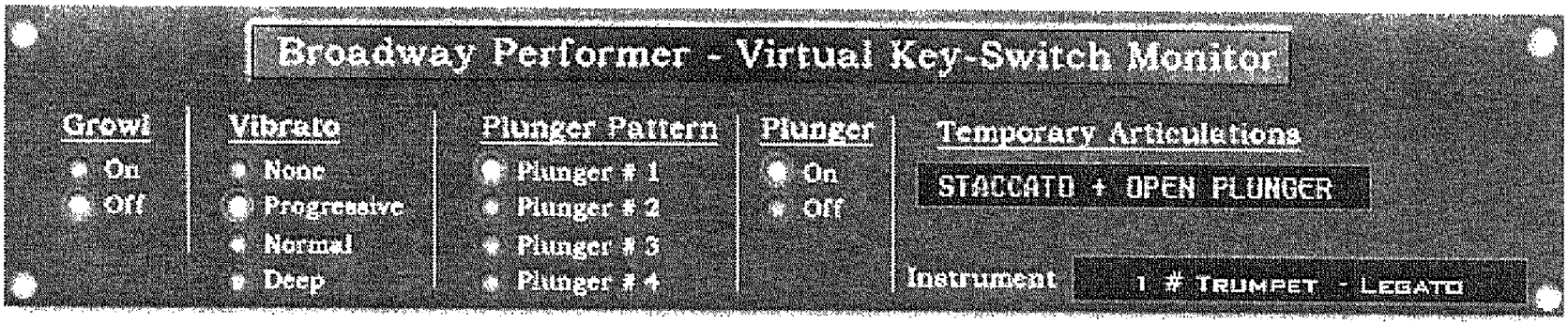
FIG. 8 is a photographic image of a screen shot of an exemplary virtual key-switch status monitor according to one embodiment of the invention.

The triggering or releasing of the proper virtual key-switches determines the playing state value 70 of the instrument. This value is stored in memory for access by a virtual key-switch status monitor 72. In this regard, the virtual key-switch status monitor 72 updates its graphical display according to any changes in the playing state of the instrument for allowing a user to easily keep track of the current playing state. FIG. 8 is a photographic image of a screen shot of an exemplary virtual key-switch status monitor according to one embodiment of the invention.

MIDI notes recognized as playable notes are handled by the note transition module 32 for note transition processing in step 74. Note transition processing is conventional in the art, and generally involves checking if there is a note already played at the time a new note is received. If there is, the interval between the two notes is calculated, and the corresponding combination of MIDI controller values and MIDI note is sent out according to the played interval and the current playing articulation. Otherwise, a different combination of MIDI controller values is generated that corresponds to a non-legato note in the current playing articulation. Of course, in the embodiment where the MIDI processor 14 is implemented as part of the sample player 16, no MIDI outputs need to be generated. Instead, the appropriate patch is selected by the sample player.

In processing the playable notes, the MIDI processor 14 further engages in selecting the proper audio sample for the notes. In this regard, the MIDI processor accesses individual alternate cycles maintained for each note of each instrument, articulation, and dynamic level, and selects the next alternate sample in the proper cycle.

Before MIDI output is generated in step 78 (in embodiments where the MIDI processor is separate from the sample player 16), additional MIDI controller data may be generated by the MIDI data morphing module 36 from velocity and modulation wheel data morphing in step 60. According to one embodiment of the invention, the MIDI data morphing module 36 generates a series of one or more MIDI controller messages in certain intervals of time, based on the velocity of the played note and the current position of the modulation wheel, for a smoother change of dynamics.

The MIDI data morphing module 36 also generates MIDI note data corresponding to dynamic layer changes, to work in conjunction with the dynamic layer morphing module 44. According to one embodiment of the invention, the dynamic layer morphing module processes the audio played back by the sample player 16 according to the data generated by the MIDI data morphing module 36, and engages in dynamic layer morphing in step 80 of different audio files for a smoother transition from one dynamic layer provided by one audio file to another dynamic layer provided by a different audio file.

I. Note Transitions

At any given time, there is a single State an Instrument operates by (the "Current State"). The Current State dictates a note-transition function ("Transition Function") used for generating MIDI information based on played notes. The Transition Function outputs two MIDI controller values and a single note, based on two input notes. The first input note corresponds to the first note in the note-transition, while the second input note corresponds to the second note in the note-transition. The size of the interval is measured by comparing the values of the two input notes. The outputted MIDI controller values are used for the patch selection in the sample player 16 and represent the corresponding music interval as it is pre-recorded and properly mapped to be triggered by the predefined MIDI controller values, while the outputted note is the actual MIDI note that is played to the sample player in the selected patch. A note-transition is created by playing a new note while a previous note is still held (hasn't been released). The new note, along with the previous note (in case several notes are being held, the note with the latest start time is selected), are fed into the Transition Function, and the function's output is then sent out to the sample player.

New notes are treated in the same way, where the first parameter for the function is −1 (indicating an invalid MIDI note) and the second parameter for the function is the new note.

Since each State has its own Transition Function, the same note-transition may generate a different combination of MIDI controller values and output note, based on the Current State.

According to one embodiment of the invention, virtual key-switches are used for triggering different styles of note transitions and other patches. Using MIDI controllers for patch selection instead of key-switches enables an amazing number of different patches to be selected in real-time and leaves the entire range of virtual MIDI keys available for mapping. According to one embodiment, two MIDI controllers are employed, enabling more than 16,000 different patches.

II. Virtual Key-Switch Module

Virtual key-switches ("VKS") are an enhancement of regular key-switches. According to one embodiment of the invention, VKS's are special MIDI notes that are not used for playing, but rather for patch selection and state transition. When a VKS is pressed (or released, in the case of bidirectional VKS), the instrument changes its performance state accordingly. The instrument's state includes a transition function and a VKS map. The transition function is used by the note transition module 32 for retrieving the output information that is sent to the sample player based on the input MIDI data. The VKS Map is the mapping of VKS's to their actual functionality, i.e. the state that the instrument enters by pressing (or releasing) a VKS and the VKS's behavior.

According to one embodiment of the invention, VKS's are divided into two main categories: Unidirectional and Bidirectional.

A Unidirectional VKS ("UVKS") is activated much like a regular key-switch in that it affects notes played after it even if it was released. In fact, according to one embodiment of the invention, releasing a unidirectional VKS after it has been pressed has no effect whatsoever. Unidirectional VKS's are grouped into separate, non-overlapping groups, based on functionality ("VKS Group"). According to one embodiment of the invention, there is exactly one selected VKS from each VKS Group at any given time. A UVKS becomes selected when it is pressed and remains selected until a different UVKS from the same VKS Group is pressed. This division makes it possible to reach many different articulations, which are the result of combining the selected UVKS from the various groups. Since each group refers to a specific aspect of the musical articulation, it makes it more intuitive than simply selecting the corresponding patches as users currently do using standard key-switches. Since each UVKS changes the performance state of the entire instrument, including the functionality of other Virtual Key Switches, it also enables reaching a large number of different patches of articulations using a small number of physical keys of the MIDI keyboard.

According to one embodiment of the invention, Unidirectional VKS's are further divided into two types: Passive and Active. A Passive UVKS does not affect any note that was played before the UVKS was pressed. Only notes played after the UVKS was pressed are affected by it. An Active UVKS affect notes that are currently being played, even if triggered prior to pressing the active key-switch. This is useful for switching, for example, between "growl-on" and "growl-off" modes. Thus, unlike key-switching in the prior art which does not allow the applying of a key-switch to a note that has already been pressed.

According to one embodiment of the invention, a Bidirectional VKS ("BVKS") affects only notes which are played while the VKS is pressed. As soon as the VKS is released, the instrument reverts to the state it was in before the VKS was pressed, assuming no other VKS was pressed since then. If one or more other VKS's were pressed since the original bidirectional VKS was pressed, then, upon release of the original bidirectional VKS, the instrument will change its state to reflect the new set of active VKS's. Thus, a BVKS enables switching to a different patch of articulation by pressing a key-switch and returning to the previous playing technique by releasing the pressed key-switch. This is an improvement over prior art key-switching where, in order to return to a previous playing technique, a specific key corresponding to that playing technique had to be selected.

According to one embodiment of the invention, Bidirectional VKS's are divided into three types: Passive, Active and Semi-Active. A Passive Bidirectional VKS affects notes played after it is pressed but before it is released. When such a key-switch is pressed, it does not affect any note that is already pressed. In the same way, releasing the key-switch does not affect any note that was pressed before. This may be useful for occasional articulations such as, for example, staccato, marccato, and the like.

A Semi-Active BVKS behaves just like a Passive one, except that in the event that there is an active note at the time the BVKS is pressed, the BVKS affects the active note as well, replacing it with a new note, as if the note was played after the BVKS was pressed. This may be useful for articulations such as, for example, alternate-fingering, clap-bend, and the like.

An Active BVKS behaves just like a Semi-Active one, except that in the event that there is an active note at the time the BVKS is released, the active note is replaced with a new one, reflecting the new state of the instrument, as if the active note was played after the BVKS was released. In other words, an Active Bidirectional key-switch affects the active note on press and on release.

Bidirectional VKS's are also affected by the combination of selected Unidirectional VKS's, which again makes it possible to reach many articulations and effects in real-time without the need for many keys and with less different keys to remember. The few keys that are used make more intuitive sense, being based on the various aspects of musical articulations instead of representing single patches.

1. Special Keys in the Virtual Key-Switch System

In order to further minimize the amount of physical keys required to access the various playing states, certain virtual key-switches are given special functionality. According to one embodiment of the invention, these keys are referred to as "Option Keys" and "Shift Keys."

Shift Keys and Option Keys are both members of the Bidirectional VKS group. However, they have additional functionality. According to one embodiment, the Shift Key may function like a traditional shift key on a computer keyboard. While holding the Shift Key, the functionality of some of the other VKS's changes. This allows multiplying the switching possibilities offered by each of the other VKS's of the system. It is possible to combine several Shift Keys just like it is possible to combine the traditional shift and control keys on a computer keyboard.

Since, just like the control and shift keys of a computer keyboard, the Shift Keys of the Virtual Key Switch System do not have an effect of their own but rather only the ability to affect the functionality of other VKS's, the Shift Keys may also be used to influence the functionality of Unidirectional VKS's without presenting functionality conflicts.

According to one embodiment of the invention, Option Keys are similar to the Shift Keys but with two main differences. First, Option Keys do have a functionality of their own and they only function as Option Keys when combined with other predefined VKS's. Second, Option Keys may only affect Bidirectional VKS's, because since they have a switching functionality of their own they might present switching conflicts in some cases.

In fact, Option Keys in the Virtual Key-Switch System are simply Bidirectional Virtual Key Switches which have added functionality when combined with other Bidirectional Virtual Key Switches. According to one embodiment of the invention, two shift and option keys are defined. However, a person of skill in the art should appreciate that each and every one of the Bidirectional VKS's may be defined as an Option Key.

According to one example, the two shift Keys are A0 and B0, and the two option keys are the same keys that are assigned to the articulations "staccato" (D#0) and "staccatissimo" (C#0). Different combinations trigger different variations of the basic articulation. For example, F#0 stands for "fall." By default, a standard short "fall down" articulation is triggered upon selection of the F#0 virtual shift-key. However, holding the option-2 key (D#0) with F#0 results in a "glide down" which is a shorter, less radical effect similar to a fall. Furthermore, holding both option-1 and option-2 results in a "fall down-slow" articulation.

Another example is choosing different vibrato styles. According to one example, C1 selects a "progressive vibrato" style, and D1 selects a "deep vibrato" style. Holding a shift key-2 (B0) before hitting C1 selects "no vibrato" and holding the shift key-2 before hitting D1 selects "normal vibrato." All of these vibrato-style selections have a passive unidirectional behavior, affecting notes played after the key-switch is triggered. However, holding shift key-1 (A0) before hitting any of these keys changes the behavior to active, affecting notes that are already being played, and further changing these behaviors on the fly.

It should therefore be appreciated by a person of skill in the art that the virtual key-switching mechanism according to embodiments of the present invention makes it much easier and more intuitive for the user to switch between different articulations and enables a much faster operation that may be used in fast paced real time performance.

FIGS. 5A-5B are functional diagrams illustrating the mapping of various virtual key-switches to associated musical concepts for applying the musical concept to one or more musical notes. The applying of the musical concept causes a transition from a current playing state to a playing state corresponding to the musical concept.

2. Examples of Possible Applications of Virtual Key Switches

In many sample libraries and multi-sample based virtual instruments, sample patches are assigned for special effect articulations that are almost never used for an extended amount of time and for a series of consecutive notes. A good example for that is falls.

According to prior art key-switches, after performing a fall sample (assuming that the "falls" patch was selected by a standard key-switch) the user is required to use an additional key-switch in order to be able to get back to the previous articulation and will have to remember which key switch is assigned for that articulation. On the contrary, using a Bidirectional Virtual Key-Switch in order to access such special effect articulations, the sample patch of the special effect articulation is active as long as the Bidirectional Virtual Key-Switch is pressed, and will be immediately deactivated as soon as it is released. In this way, the user will automatically be back in the desired position of the articulation patch he was using right before activating the special effect articulation.

Extending the example dealing with falls, many times the user may wish to perform a special articulation such as falls, not necessarily with newly played notes, but as the ending of notes that are already being played that might be a part of a legato phrase. The prior art currently does not support such actions to be performed in real-time. However, such actions are enabled by the Active Virtual Key-Switches (AVKS) according to one embodiment of the present invention. For example, after playing a note without special articulation, the user may trigger an active key-switch that is assigned to the desired articulation (in this example, a fall) and the virtual key-switch module 34 triggers a cross-fade sample (in this case, a "fall from sustain" sample) which not only does not have the attack of a new note, but actually also has the tail of the sustain from which it falls. This enables a smooth and quick cross-fade of typically 30 milliseconds between the sustained note that was played by the user before triggering the AVKS and the "fall from sustain" sample which is triggered by the AVKS.

While in most cases the default note-transition style of sampled instruments using the VKS's described in accordance with the various embodiments may be legato, several other note-transition styles may also be sampled and used based on user commands. Specifically, the user may choose to use different note-transition styles appropriate for the musical performance by the system via either Unidirectional or Bidirectional Virtual Key Switches. A trumpet, for example, may be configured to play legato by default, a rip-portamento effect when using a particular Bidirectional VKS, or a chromatic-run transition when using a different Bidirectional VKS, granted that these note transitions are sampled and available. This may also enable special note-transitions such as smear-legato and glissando for woodwinds and trombone, and the like.

As discussed above, UVKS's function as multiple groups. According to one embodiment, each group represents a single aspect of the musical articulation or playing technique. Since the different aspects could create many different combinations which would result in many different combined musical articulations, the grouping of UVKS's enables a highly intuitive way of accessing a large number of different combined articulations using a small number of physical keys, as in the following example.

A trumpet may have the following groups of Unidirectional Virtual Key Switches:

a. Flutter tonguing on/off b. Vibrato type (normal, progressive, deep or none).

c. Plunger on/off d. Plunger patterns (various patterns to choose from)

An exemplary default setting of this exemplary trumpet is as follows: Flutter tonguing=off; Vibrato type=progressive; and Plunger=off. When triggering the VKS which turns the Fluttering tonguing on, the various vibrato types will not trigger the sample of the various vibrato styles recorded without flutter tonguing, but will rather trigger the samples of the vibrato styles recorded with flutter tonguing. Without using this system of Virtual Key Switches, this would have required additional key-switches acting as patch selectors that represent the additional various sample patches.

Furthermore, the functionality of the various Virtual Key Switches of the vibrato mode group may be used for choosing a plunger mode instead whenever the VKS for turning the Plunger on is activated. In this way, the same keys used for the vibrato mode group may now be reused for a different purpose of choosing a plunger mode. Once again, each of the plunger patterns may trigger different samples based on the particular flutter tonguing mode that has been selected.

Quite conveniently, all of the above is also applicable for combining Unidirectional VKS's with Bidirectional VKS's, and in some cases could be even applied for combining several Bidirectional Key-Switches which are activated simultaneously.

According to another example, a saxophone has may have the following groups of Unidirectional Virtual Key Switches:

a. Growl (containing Growl On and Growl Off VKS's).

b. Vibrato (containing Progressive Vibrato, Normal Vibrato, Deep Vibrato and No Vibrato VKS's)

c. Note-Transition (containing Legato and Detache VKS's).

An exemplary initial state of the exemplary saxophone is as follows: Growl=Off, Vibrato=progressive vibrato, and Note-Transition=Legato. Pressing the VKS for Deep Vibrato causes every note, including notes that result from a legato note transition, to have a deep vibrato. Pressing the VKS which turns Growl on causes the VKS to pick the Growl with Deep Vibrato sample patch. Pressing the No Vibrato VKS will pick a Growl with a No Vibrato sample patch. Finally, pressing the Fall Down Bidirectional VKS will pick the Fall Down with Growl sample patch instead of the regular Fall Down patch.

According to one embodiment of the invention, the system is optimized to work in legato mode, allowing only monophonic behavior of the instruments. According to another embodiment of the invention, the system works in a polyphonic mode. One of the main differences is that in polyphonic mode, there are no legatos or note transitions with the exception of repetition (for wind and string instruments) and a few special features for pluck string instrument and percussive instruments. For example, tuned mallet percussion such as Xylophone may have a Virtual Key Switch that activates a "note-on" event, playing an additional strike as a response to "note-off" events coming from the MIDI keyboard to help creating tremolo effects in an easier manner when playing a MIDI keyboard.

In another example, pluck string instruments such as banjo and guitars may have several special Virtual Key Switches to reproduce a realistic strum effect. For example, a VKS or a group of VKS's that determine whether the "note-on" and "note-off" events from the MIDI keyboard are translated to simply "note-on" and "note-off" events or rather become "up" and "down" performances of hitting the strings, where "note-on" represents the "down" movement and "note-off" represents the "up" movement. A different VKS may invert the order and make the "note-on" events represent the strike-up performance and the "note-off" event represent the strike-down movement (which would typically be used with instruments such as banjo, due to musical context).

Another strumming technique is "Strum Mode." According to one embodiment, the Strum Mode is activated by a Unidirectional VKS, and completely changes the performance technique for the user. In the Strum Mode, the right hand holds down the notes which the user wishes to include in the strummed chord, while the left hand activates the actual notes by using a series of Semi-Active Bidirectional VKS. Each of those VKS's represents either "strike-up" or "strike-down" strums in various playing techniques, such as sustain, half-muted, fully-muted, staccato, and the like. Strum Mode also simulates the strumming effect by creating a slight delay between the various notes of the chord according to the strum direction (up or down) and velocity (soft is slower, loud is faster). It also assigns samples of the proper string in case the same note was recorded from various different strings, so that one string will not be used twice in the same chord, and in cases of 6-string guitars, this feature may double a note or two of the existing chord notes the user is holding to make sure all 6 strings of the virtual guitar will be used even if the user has only chosen fewer notes. In such a case, an additional special mode may be enabled for "5-string-chords" in which the lowest note of the chord is used as a separate base note to be activated by a separate VKS and the rest of the notes are used for the strumming effect.

Figure 11A:
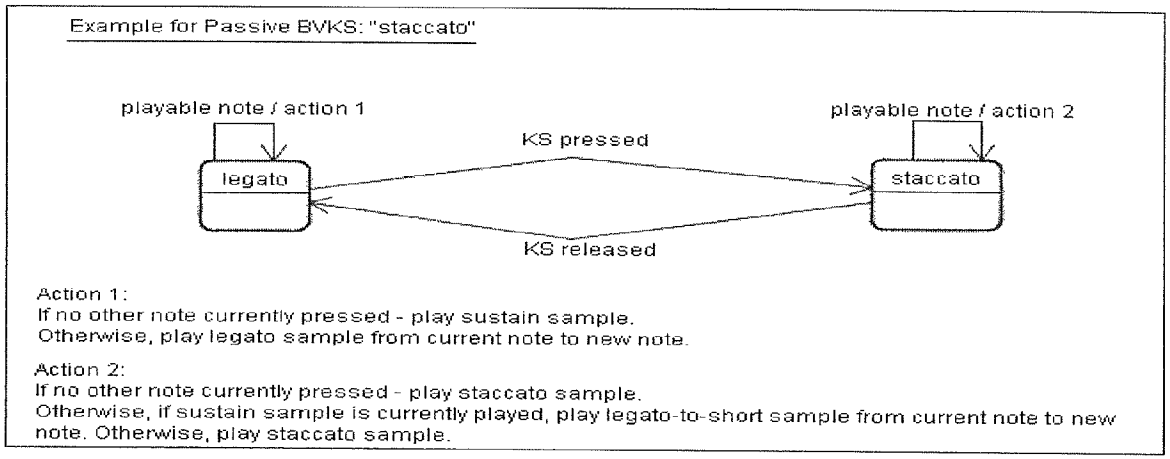
FIGS. 11A-11D are state transition diagrams of different playing states in response to actuation of different types of exemplary virtual key-switches.

FIGS. 11A-11D are state transition diagrams of different playing (performance) states in response to actuation of different types of exemplary VKS's. FIG. 11A illustrates the performance state in response to selection of a "staccato" BVKS. In action 1, if no other note is currently pressed, a sustain sample is played. Otherwise, a legato sample is played from a current note to a new note. In action 2, after the staccato BVKS is pressed, if no other note is currently pressed, a staccato sample is played. Otherwise, if a sustain sample is currently played, a legato-to-short sample is played from the current note to the new note. Otherwise, a staccato sample is played.

Figure 11B:
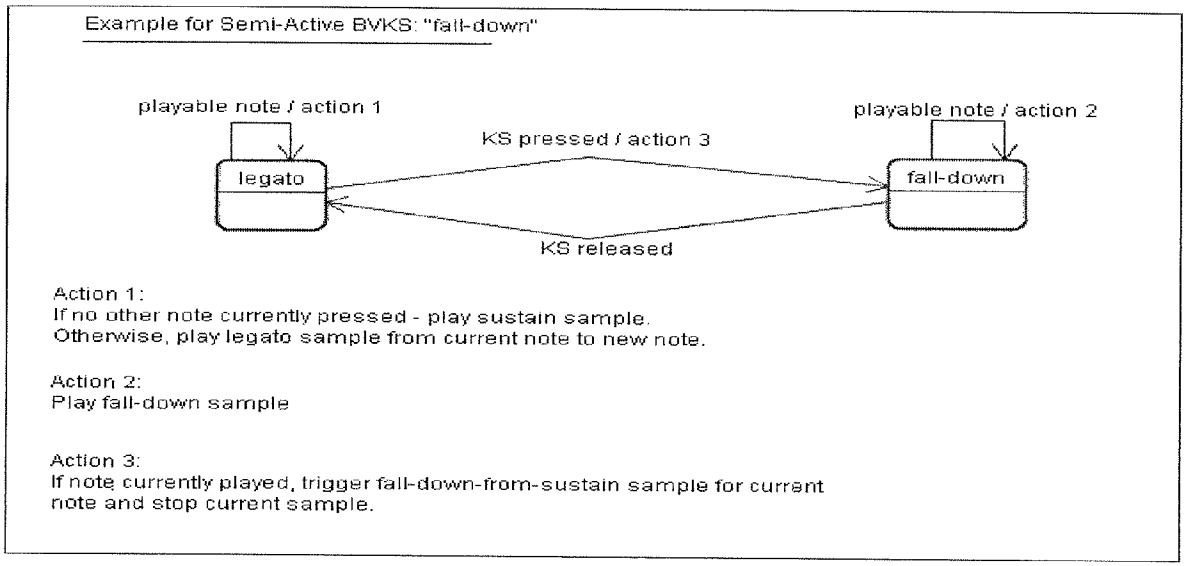

FIG. 11B illustrates the performance state in response to selection of a "fall-down" BVKS. In action 1, if no other note is currently pressed, a sustain sample is played. Otherwise, a legato sample is played from the current note to the new note. In action 2, a fall-down sample is played. In action 3, the fall-down BVKS is pressed. If a note is currently played, a fall-down-from-sustain sample for the current note is triggered, and the current sample is stopped.

Figure 11C:
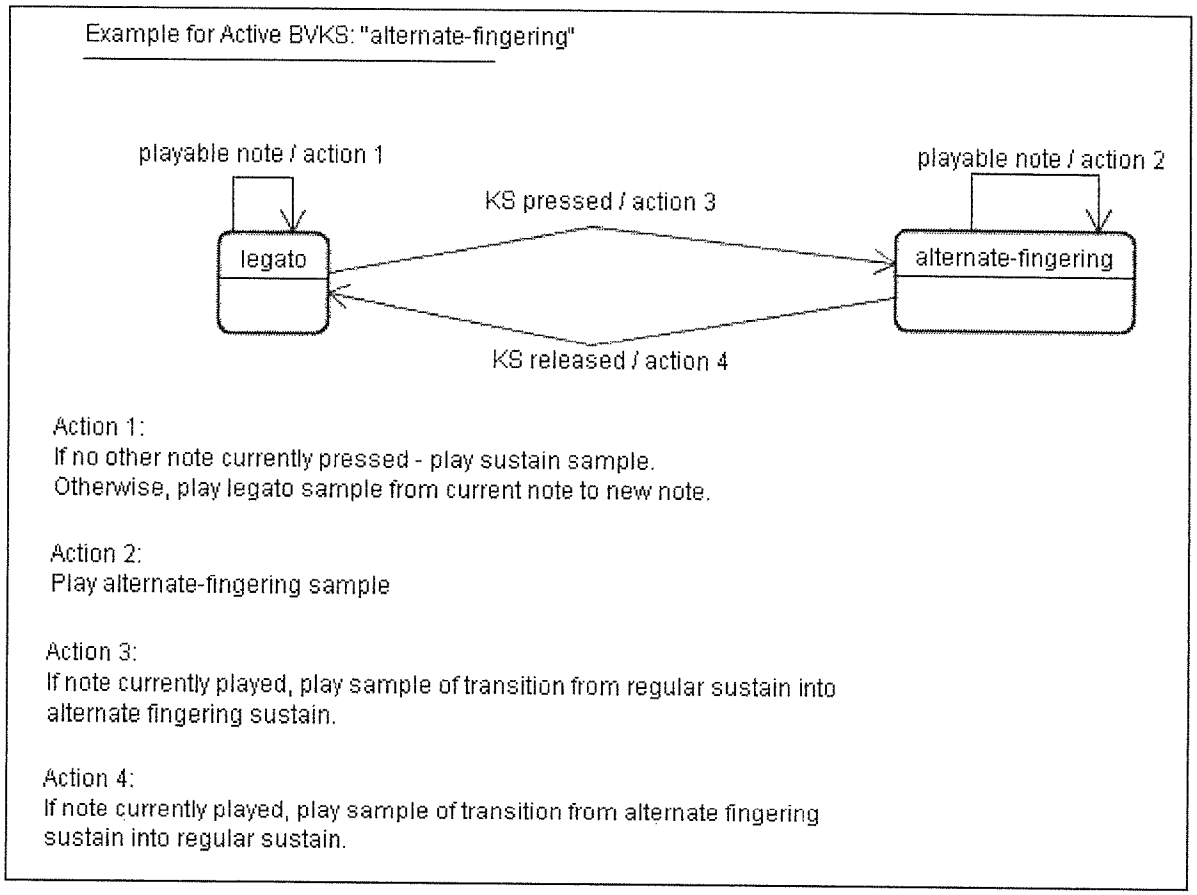

FIG. 11C illustrates the performance state in response to selection of a "alternate-fingering" BVKS. In action 1, if no other note is currently pressed, a sustain sample is played. Otherwise, a legato sample is played from the current note to the new note. In action 2, an alternate-fingering sample is played. In action 3, the alternate-fingering BVKS is pressed. If a note is currently played, a sample of transition from regular sustain into alternate fingering sustain is played. In action 4, the alternate-fingering BVKS is released. In this case, if a note is currently played, it plays the sample of transition from alternate fingering sustain into regular sustain.

Figure 11D:
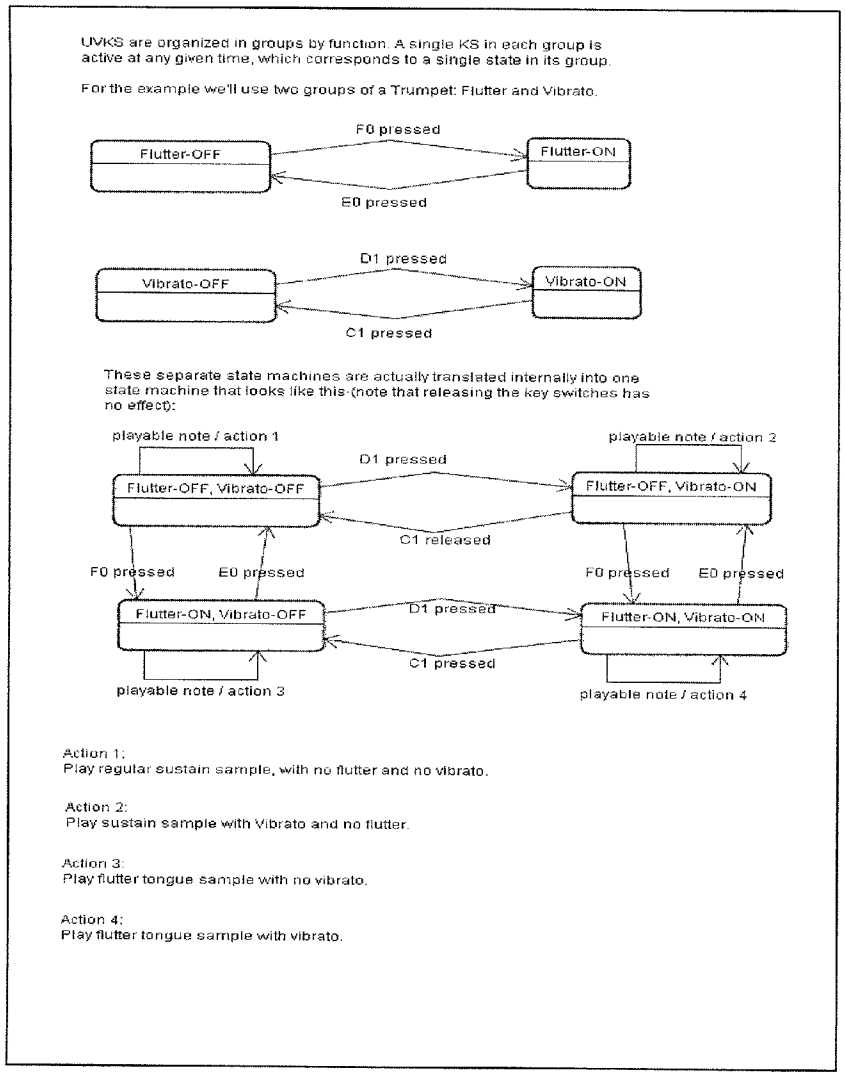

FIG. 11D illustrates how UVKS's are organized in groups by function. A single VKS in each group is active at any given time, which corresponds to a single state in its group. For example, assume two groups of a trumpet: flutter and vibrato. In action 1, a regular sustain sample is played with no flutter and no vibrato. From this state, if the D1 VKS is pressed and a new playable note is pressed as indicated in action 2, the sustain sample of the new playable note is played with vibrato and no flutter. However, if the F0 VKS is pressed and a new playable note is pressed as indicated in action 3, the flutter tongue sample is played with no vibrato. In action 4, a flutter tongue sample is played with vibrato in response to D1 VKS being pressed from a flutter-on, vibrato-off state, or in response to F0 VKS being pressed in response to a flutter-off, vibrato-on state.

3. Repetition by Virtual Sustain Pedal

According to one embodiment of the invention, a virtual sustain pedal VKS allows note repetition events to be treated the same way as regular note-transitions (such as legato). According to the prior art, it is not possible to play on the keyboard the same note the second time before generating a "note-off" event of the first note, since it's not possible to play a note twice without releasing it first. This may pose a problem because a "note-off" event causes the former note to stop playing, and the new note will be played with a new attack, losing the continuity of the note. In order to emulate instruments, such as wind instruments, that do not share this limitation, the virtual key-switch module 34 provides a virtual sustain pedal VKS which, when actuated, delays the "note-off" event until the next "note-on" event is received. Furthermore, the samples triggered in the repetition mode are repetition samples, which have a different kind of attack and also include the tail of the former note, just like in legato mode.

In order to access repetition samples, a user selects the virtual sustain pedal VKS before releasing the note to be repeated, and then plays the note again. In response, the virtual key-switch module 34 selects the repetition sample corresponding to the note being repeated instead of the regular sustain sample. Furthermore, because of the delay of the "note-off" event, the newly selected repetition sample is played continuous with the former note, maintaining, a legato transition between the repeated notes. According to one embodiment of the invention, the virtual sustain pedal functions as a Bidirectional Virtual Key-Switch, and as such, is active as long as it is pressed, and is deactivated as soon as it is released.

According to one embodiment of the invention, the virtual sustain pedal is also useful for playing fast musical phrases in legato. Although legato may be maintained by making sure that every note is released only after the next note is played, this may be a nearly impossible task during fast musical phases. The virtual sustain pedal makes this task very easy, since as long as it is active, the musical phrase is interpreted as if it was played in legato. Thus, even if a prior note is released before the next note is played, the "note-off" event is delayed, allowing the phrase to be played in legato.

III. Real Time MIDI Processing

According to one embodiment of the invention, the real-time MIDI processing module 30 is configured for different functionalities. First, the processing module distinguishes between playable notes and virtual-key switches according to a key-switches definition and playable range of the relevant instrument. The module further recognizes the various kinds of virtual key-switches, creates a performance buffer, and organizes any virtual key-switches and playable notes in the correct processing order while managing the various MIDI processing stages of the MIDI data.

According to one embodiment of the invention, the MIDI processing module 30 addresses two deficiencies of the prior art:

1. When using the quantize function in a MIDI sequencer, the original order of notes and key-switches is lost. Instead, the sequencer plays back simultaneous notes (notes that share the same timestamp after quantizing) in a different order (typically from bottom to top, but not always). As a result, in cases where the user tries to trigger the corresponding virtual key-switch before playing the note which is supposed to be affected by it or to create any special combinations between virtual key-switches which need to be triggered in a specific order, the quantize option is likely to alter the triggering order of the various virtual key-switches and notes, especially when using special virtual key-switches such as shifts and option keys and other virtual key-switch combinations. This may create an undesirable behavior (e.g. playing the wrong music articulation).

2. In order to activate a passive virtual key-switch, the user needs to trigger the passive virtual key-switch before playing the corresponding note. However, in some cases it might be difficult to do, especially in fast-paced musical phrases. As a result, it would be easier to play the virtual key-switch and the corresponding note simultaneously. However, once again, in fast-paced musical phrases, it is still quite difficult to make sure the virtual key-switch played "with" the note is really played with it or before it and not slightly after it.

According to one embodiment of the invention, the MIDI processing module 30 addresses theses deficiencies via a short buffer which delays the playing of the received notes for a short time period which is not noticeable to a user. This delay is then used for error correction. For example, the buffer, and hence, the delay, may be a few milliseconds long, such as, for example, 80 milliseconds. The MIDI processing module 30 analyzes the MIDI notes in the buffer, and reorders the notes according to predetermined processing rules for a correct order of activation of the MIDI notes. According to one embodiment of the invention, each instrument has a different processing rule.

According to one embodiment, the buffer window's count-down is triggered when a MIDI event is received and not as a continuous cycle. This means that once a MIDI event is received and triggers the buffer window count-down, all MIDI events received within the buffer window are processed not in the order in which they were received, but instead, are reorganized and processed in a predefined processing order aimed to ensure a proper interpretation of the virtual key-switch combination that might have been used, and is far more likely to match the user's musical expectations.

For example, during a live performance, the user may make errors in the triggering of the virtual key switches. That is, some key switches may need to be pressed in a certain order, but may accidentally be pressed in a different order. The MIDI notes that have been actuated are forwarded to the buffer which does not play in real time, but with a slight delay. Within this delay, the MIDI processing module 30 processes the received notes according to the processing rule defined for the played instrument, and reorganizes the MIDI notes as needed based on the rule.

For example, assume that the buffer receives a Shift key, a key switch, and a playable note within the same window. An exemplary processing rule may indicate that the Shift key is to affect the key switch, and that both are to affect the playable note. Thus, even if the playable note is pressed slightly before the key switch, and/or the key switch is pressed slightly before the Shift key, the MIDI processing module 30 reorders the notes so that the Shift key is followed by the key switch which is then followed by the playable note.

In another example, when using passive VKS's that share the same triggering physical key with an active VKS of a similar articulation, a problem may occur if the user wants to affect an upcoming note without triggering the active VKS on the currently played note, since the active VKS and the passive VKS are triggered by the same physical key. In order to resolve this issue, when triggering such an active VKS, it is not immediately activated, but is rather slightly delayed for a predetermined window of time (typically about 80 milliseconds). According to one exemplary processing rule, if a new note is played within that window of time, the active VKS is not triggered. Instead, the corresponding passive VKS is applied towards the new note played. This allows the user to apply a passive VKS towards a new note without having to worry about not triggering the corresponding active VKS when it is not desirable.

This feature assists the user especially in real-time situations and allows the user an easier workflow, freeing him from the obligation of extreme accuracy when activating virtual key-switches while playing.

IV. Velocity/Modulation Wheel Data Morphing

MIDI data morphing addresses the deficiency in using the modulation wheel to change dynamics while also taking into account the velocity in which a note is played. For example, assume that a note is played with a loud velocity, and the user manipulates the modulation wheel to change dynamics (e.g. to diminuendo from it). Assume that the position of the modulation wheel is all the way down (indicating a low dynamic level), and the modulation wheel is then actuated for achieving the diminuendo. According to prior art systems, the dynamic level jumps from really loud to really low when the modulation wheel is actuated, causing an abrupt change of dynamics.

According to one embodiment of the invention, the MIDI data morphing module is configured to morph the MIDI velocity value of currently played notes with the dynamic level data from the modulation wheel to generate a morphed value aimed to prevent an abrupt value change in dynamics. A person of skill in the art should recognize that morphing may also be employed based on the manipulation of other MIDI controllers other than the modulation wheel, such as, for example, a volume pedal.

According to one embodiment of the invention, morphing of the MIDI data allows the user to quickly move the modulation wheel to the position where he or she wants the movement to start. The MIDI data morphing module 36 is configured to generate dynamic level values that "chase" (i.e. move towards) the new value generated by the modulation wheel due to the moving of its position. However, the "chasing" starts slowly first, allowing the modulation wheel to be quickly moved to the desired initial position.

The data morphing generates a new value that represents the dynamic level of the instrument. This new value is communicated via a specialized MIDI controller, and is also used by the MIDI data morphing module 36 to determine the velocity value of the MIDI notes it generates. The MIDI controller information sent by the MIDI data morphing module is then provided to the dynamic layer morphing module 44 to properly adjust the parameters of filtering and amplitude envelopes as is described in further detail below.

According to one embodiment of the invention, the morphed data value starts from the initial velocity value of the note that was pressed, and chases the modulation wheel by filling in gaps in the dynamic level value for smoothing the level change.

Figure 6:
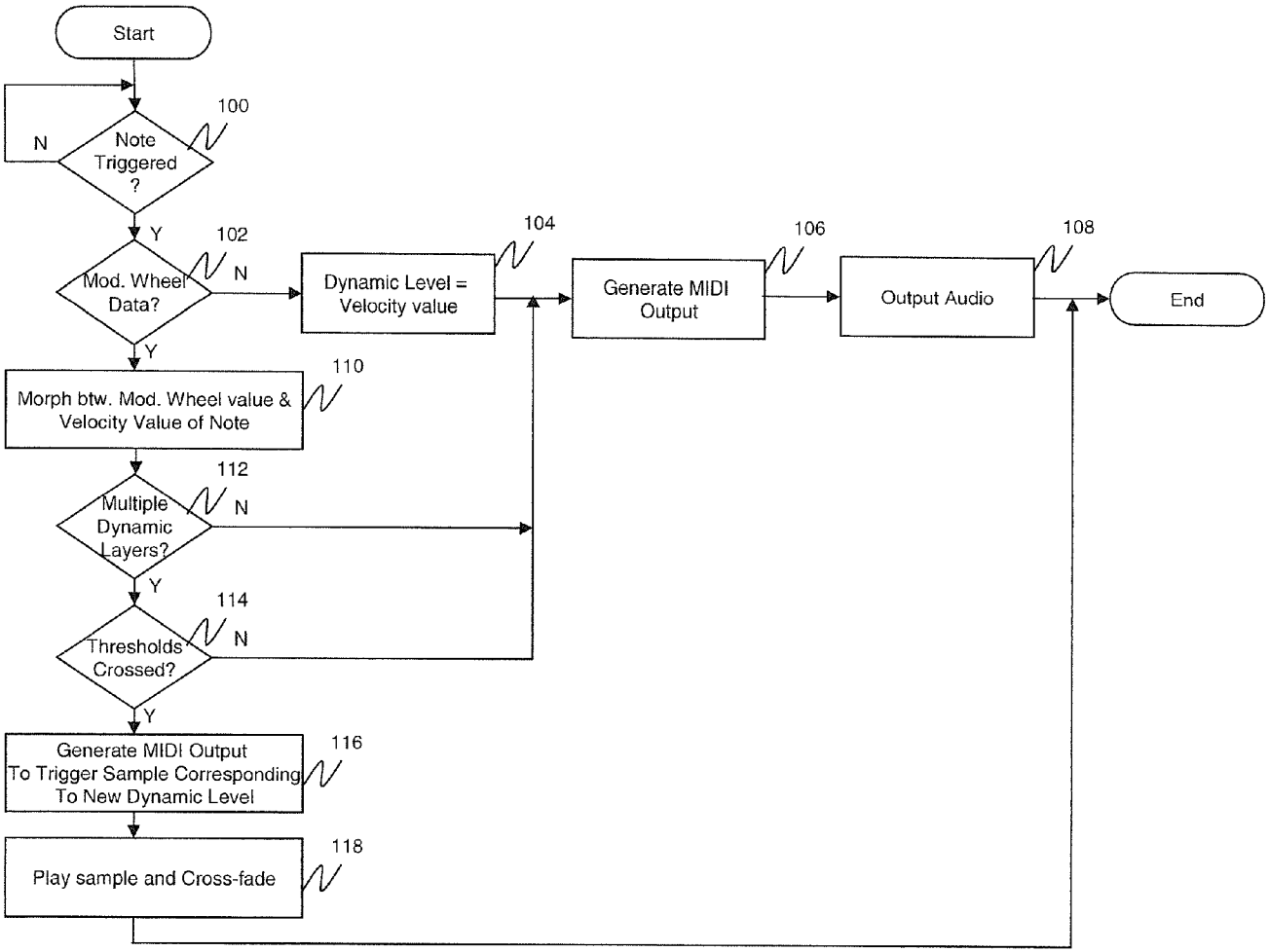
FIG. 6 is a flow diagram of a process for effectuating dynamic changes according to one embodiment of the invention.

FIG. 6 is a flow diagram of a process for effectuating dynamic changes according to one embodiment of the invention. The process starts, and in step 100, the MIDI data morphing module 32 determines whether a note has been triggered. If the answer YES, a determination is made as to whether it has received any modulation wheel data. If the answer is NO, the dynamic level value inherits the velocity value generated by the triggered note in step 104. The appropriate MIDI output is then generated in step 106, and an audio output is generated with the appropriate velocity in step 108.

If the MIDI data morphing module 32 has received modulation wheel data and the note is still sustained, data morphing begins in step 110 by chasing the new value generated by the modulation wheel from the current value that has been generated by the MIDI notes velocity value.

The dynamic level value chases the new value (moves towards it) in steps of 1, and in a slow enough speed to allow the user to bring the modulation wheel towards the point where they meant it to be (close to the initial value generated by the played velocity) in order to prevent an abrupt change that is typically generated in cases of modulation wheel controller dynamic changes, such as crescendo or diminuendo when not using this system. In other words, the gaps in the dynamic level values are filled for smoothing the dynamic level change. As soon as modulation wheel value and the dynamic level value meet and become equal, and as long as there is no new velocity input that could trigger a change in the value, the dynamic level value would then be equal to the modulation wheel value, with one exception: whenever the modulation wheel value changes in more than a single step, the dynamic level chases the new modulation wheel value (in single steps) instead of matching the abrupt value change.

In step 112, a determination is made as to whether there is more than one sampled dynamic layer available in the instrument. If the answer is YES, this may generate a cross-fade action between the different sampled dynamic layers. According to one embodiment of the invention, the cross-fades are not generated within the sample player, but are rather managed externally by the dynamic layer morphing module 44.

In order to determine when to generate a cross-face action, a determination is made in step 114 as to whether the thresholds set for the current dynamic layer have been crossed. The threshold values may be set according to the number of dynamic layers available in the sampled instrument. According to one embodiment of the invention, two thresholds are set around the border of each dynamic layer, although a person of skill in the will recognize that only one threshold is also possible. Two thresholds are desirable to prevent unwanted cross-fades that otherwise could be caused due to inaccurate modulation-wheel readings. For example, if the modulation-wheel wobbles at the border of a particular dynamic layer that has only one threshold value, this may cause the undesirable effect of going back and forth between a previous dynamic layer and a next dynamic layer.

According to one embodiment of the invention, if only one of the thresholds have been crossed, the next dynamic layer is not triggered and no cross-fading occurs. However, if both thresholds have been crossed, the MIDI morphing module generates, in step 116, a MIDI output for triggering a sample corresponding to the new dynamic level. In order to generate a cross-fade during a crescendo movement, the upper threshold(s) of the border needs to be crossed, while in order to generate a cross-fade during a diminuendo movement, the lower threshold(s) of the border needs to be crossed. This helps minimizing the amount of cross-fades generated by the system.

In step 118, the dynamic layer morphing module 44 plays the next dynamic level and performs a quick cross-fade of a predetermined duration configured to optimize cross-fade results and minimize phasing artifacts, and it is not affected by the speed of the modulation wheel movement. According to one embodiment of the invention, the cross-fade duration is around 100 milliseconds.

The sample corresponding to the proper new dynamic level may be triggered with a Note-On message. According to one embodiment of the invention, this sample does not include a natural attack, and is sent to a separate audio output (using L/R separation). The existing note is kept playing until the end of the cross-fade action, and as soon as the cross-fade action is completed, a Note-Off message is generated for the old note while the new note is kept playing.

If new notes are generated during modulation wheel movement, the velocity values of the new notes are ignored, and the dynamic level value inherits the value generated by the modulation wheel. This mode enables the creation of smooth crescendo and diminuendo effects throughout a legato passage. This is also very useful for wind control applications and the like.

V. Dynamic Layer Morphing

As discussed above, the dynamic layer morphing module manages cross-fades when transition from one dynamic sample to another. The dynamic layer morphing module is configured address a deficiency that occurs when trying to use standard cross-fade for crescendo and diminuendo effects when the samples are samples of solo instruments. Specifically, when using a standard cross-fade between the samples of the different dynamic levels with solo instruments, especially wind instruments, there often is a phasing effect that occurs during the cross-fade that makes the solo instrument sound momentarily like a small section because two separate samples of the same instrument may be heard at the same time for long enough for the listener to notice, and without aligning the wave forms to match and prevent phasing effects. Because such alignment between the wave forms is not possible when including real vibrato in the sampled sounds, the dynamic layer morphing module 44 provides an alternative solution.

Furthermore, wind instruments have the tendency to have a continuous change of timbre throughout a crescendo and diminuendo performance. This continuous change of timbre is produced by cross-fading. The dynamic layer morphing module is configured to address these two deficiencies by both changing the timbre of the played samples using equalizers and filter systems, and by managing the cross-fades between the different samples in such a way that would enable a short enough cross-fade between the samples that would not expose any misalignment of the wave forms and will prevent from any phasing effects to be spotted by the listener.

Figure 7:
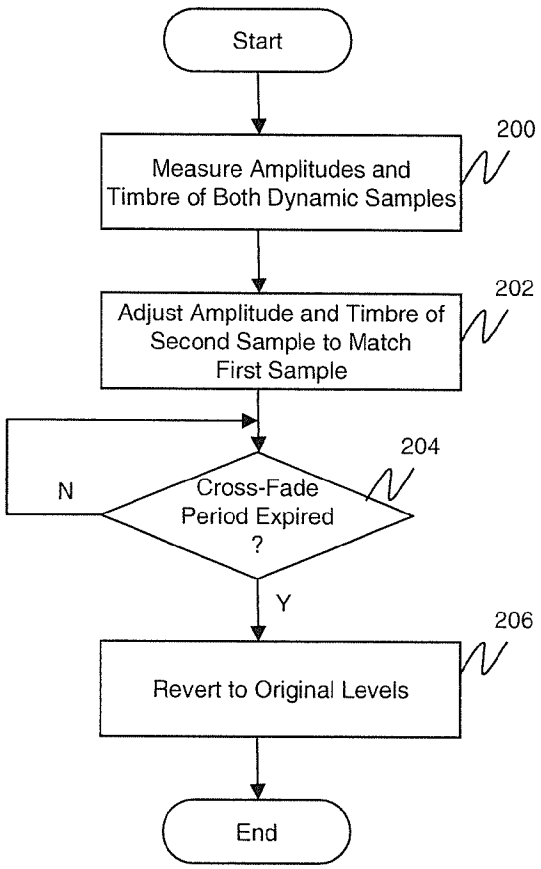
FIG. 7 is a flow diagram of a process for dynamic layer morphing according to one embodiment of the invention.

FIG. 7 is a flow diagram of a process for dynamic layer morphing according to one embodiment of the invention. In step 200, the dynamic layer morphing module 44 measures the amplitude levels and timbre of the two samples which are being cross-faded (i.e. the sample corresponding to a prior dynamic level and a sample corresponding to the new dynamic level), before the beginning of the cross-fade action.

In step 202, the dynamic layer morphing module 44 momentarily adjusts the amplitude level and timbre of the new sample to match the prior sample for achieving a smooth and transparent cross-fade action.

In attempting to match the timbre, the dynamic layer morphing module is configured with a set of predefined EQ and filter curves in order to further smooth the cross-fading point between the different samples. The EQ and filter curves are defined by analyzing the different timbre of each sampled dynamic layer, and attempting to match between them. Cross-adjusting the timbre of the different sampled dynamic layers helps not only to further smooth the cross-fade points, but also to create a smoother more natural dynamic growth during a crescendo or diminuendo performed by the system, and virtually expand the dynamic range of the sampled instrument beyond its original dynamic limits. When using the dynamic layer morphing in a non-cross-fade scenario, this sub-component virtually adds an unlimited amount of dynamic levels "in between" the original sampled ones.

In step 204, a determination is made as to whether the cross-fade period has expired. If the answer is YES, the dynamic layer morphing module 44 smoothly reverts to its original amplitude level and timbre.

VI. MIDI Pattern-Based Groove Performer

According to one embodiment of the invention, a user uses a combination of upper-level virtual key-switches to choose between various prerecorded MIDI patterns (using MIDI files), which already include some "standard-level" virtual key-switching information, and (for tuned instruments) applies MIDI notes played by the user to the selected pattern. This helps generate a complex MIDI output to be played by the sample player. This generated output includes various MIDI controller and MIDI note events, which are potentially impossible to play in real-time without using this tool.

According to one embodiment of the invention, the MIDI pattern-based groove performer module 42 is configured to analyze the musical relationship between the combination of notes played by the user (a chord) and the notes appearing in a selected MIDI pattern. The module then assigns the notes played by the user to their musical functionality as defined in the selected MIDI pattern. This helps expedite the process of creating complex rhythmical patterns by the user when using instruments that require frequent usage of virtual key-switches within fast-paced rhythmical patterns, such as banjo, guitars, and other instruments as needed.

The MIDI pattern-based groove performer module 42 also enables the creation and usage of groove libraries, especially tailored for instruments sampled according to this mechanism, which may be carefully created and, in some cases, recording the real performance of musicians combined with advanced programming of virtual key-switch patterns, such as the MIDI recording of a guitar player using a MIDI guitar combined with the proper advanced programming of virtual key-switches to define the direction of the plucking (up or down) and articulation (sustain-no-vibrato/sustain-with vibrato/staccato/half-muted/fully-muted, etc). Without the MIDI pattern-based groove performer module, the process of creating comparable realistic patterns by the user would require significantly more time and effort to be invested by the user, time that in many cases, in professional circumstances, the user cannot afford investing.

The user may activate or deactivate the MIDI pattern-based groove performer module by using virtual key-switches. Once it is activated, keys on the physical MIDI keyboard that are otherwise used to trigger virtual key-switches become groove-selectors that enable the user to switch between the various patterns available for the instrument. The user may then deactivate the MIDI pattern-based groove performer module, and the same physical MIDI keys become the triggers of the virtual key-switches they normally are.

According to one embodiment of the invention, this is accomplished by using pre-edited MIDI patterns which may be switched in real-time by the user via predetermined keys on their MIDI keyboard. This allows for hyper-realistic sounding patterns, fully adjustable to scale and tempo, and since it outputs MIDI performance to the sample player in the same way it would have been sent had these patterns been played by the user in real-time using virtual key-switches (without the usage of pre-edited MIDI patterns), the instrument (program) loaded onto the sample player is the same. This means that pattern-based performance and non-pattern base performance could be interweaved without creating inconsistency in timbre.

VII. Individual Alternates Cycling

According to one embodiment of the invention, the alternates selection module 38 improves the quality of the cycling used for activating alternate samples (alternates), by creating individual cycles of alternates for each note of each dynamic layer of each articulation in the program (instrument). Thus, unlike the prior art, a single instrument may have hundreds of cycles, and different, inconsistent number of alternate samples may be provided for each note of each articulation of each dynamic layer for the instrument. Of course, a person of skill in the art should recognize that individual cycles may also be provided based on other musical styles associated with the instrument.

An example of a prior art mechanism of selecting alternatives will be useful. According to this example, there two notes where each note has two alternate samples, A1 and A2 for a first note, and B1 and B2 for a second note. When playing a trill with these two notes, the processor selects in a first step of the cycle, the first alternate of the first note (A1) and moves the cycle to the next step for selecting a second alternate (B2) for playing the second note. Because there are only two alternates available, the processor goes back to the first step of the cycle when playing the first note, which causes the selection of the first alternate (A1) again. According to this example, a trill involving these note notes never accesses alternates A2 and B1.

In contrast, the alternates selection module 38 provides a separate cycle for each note of each dynamic layer of each articulation for the instrument. For example, a first note may have alternates A1 and A2 for a pianissimo dynamic layer for a legato articulation, alternates A3, A4, and A5 for a pianissimo dynamic layer for a staccato articulation, and alternates A6 and A7 for a mezzo piano dynamic layer for a legato articulation. Thus, in the above example, if it is assumed that A1, A2 and B1 and B2 are the alternates applicable to a particular dynamic layer of a particular articulation, the alternates played when playing a trill are A1, B1, A2 and B2.

Below is a chart illustrating the above example. Assume that both notes C4 and D4 have 2 alternates, and that in the prior art sample, there is one global cycle with 2 alternates.

| Action | Output in prior art | Output in current invention |
|---|---|---|
| Play C4 | C4 $1^{st}$ alternate | C4 $1^{st}$ alternate |
| Play D4 | D4 $2^{nd}$ alternate | D4 $1^{st}$ alternate |
| Play C4 | C4 $1^{st}$ alternate | C4 $2^{nd}$ alternate |
| Play D4 | D4 $2^{nd}$ alternate | D4 $2^{nd}$ alternate |
| Play C4 | C4 $1^{st}$ alternate | C4 $1^{st}$ alternate |

According to the prior art, when playing a trill of C4 and D4, both C4 and D4 keep repeating the same exact alternate sample, even though 2 alternates exist for each of them. According to embodiments of the present invention, however, each note's cycle changes independently of the others, and therefore each note will loop though all of its alternate samples before repeating itself. It also eliminates the need to have the same amount of alternates for each note. Each note, in each dynamic layer, in each articulation, can have a different amount of alternate samples, without the need to duplicate samples.

Figure 9:
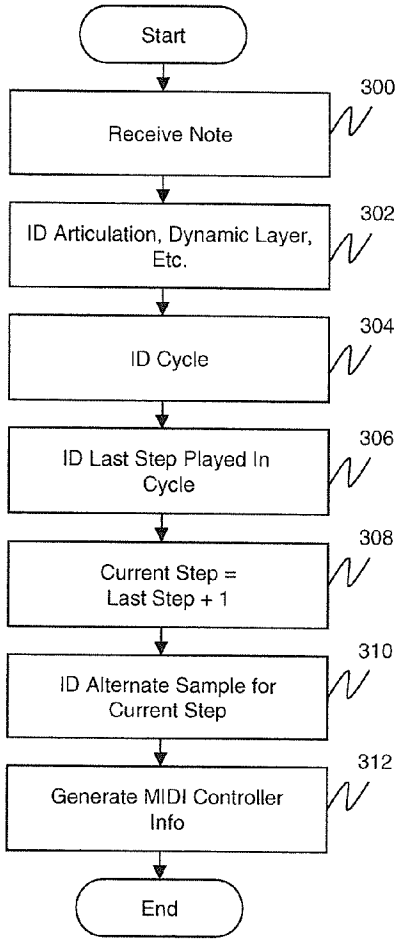
FIG. 9 if a flow diagram of a process for selecting alternate audio samples according to one embodiment of the invention.

FIG. 9 if a flow diagram of a process for selecting alternates according to one embodiment of the invention. According to one embodiment, this process is the last process in the chain of MIDI processing in the system before sending MIDI messages to the sample player 16.

In step 300, the alternates selection module 38 receives a note to be output and identifies, in step 302, the articulation, dynamic layer, and any other predetermined musical characteristic for the note for the associated instrument invoked.

In step 304, the alternates selection module identifies the corresponding cycle of alternates for the identified articulation and dynamic layer for the note.

In step 306, the alternates selection module determines the last step that was played in the identified cycle, and in step 308, moves forward to the next step and sets it as the current step.

In step 310, the alternates selection module identifies the alternate sample corresponding to the current step in the cycle.

In step 312, the alternates selection module generates MIDI controller key-switch information to trigger the identified alternate sample of the note.

A person of skill in the art should appreciate that the above-described alternates selection mechanism allows complete flexibility for the amount of alternate samples for each note in each dynamic layer of each articulation. No uniform number of alternate samples is required. The instrument program's structure may be kept simpler and therefore requires a shorter loading time and consumes significantly less computer memory, which results with the ability of the user to load more instruments at the same time onto the same computer.

VIII. Advanced Alternate-samples Management Using Snapshots (Saving and Recalling Cycle Positions)

As described above, the providing of an individual cycle for each note of each dynamic layer of each articulation for each instrument produces a very large number of such cycles. Thus, it is desirable to have a mechanism for user control over his or her preferred alternate samples without making it a tedious and time consuming process. In this regard, the cycle control module 40 allows the creation of snapshots of the position in all of the existing cycles at a given time, and then allows the recalling of these snapshots using simple editable MIDI events, for either all instruments or for specific individual instruments.

For example, after recording and editing the parts of all MIDI instruments, the user may listen to the piece several times. The user takes the snapshot of the current position of all available cycles (of all of the MIDI instruments playing in the song) and then plays the song. Each time the piece is played, different alternates are invoked because the instruments continue progressing through the cycles each time a music is played. That is, there is no initializing of the cycles for each rendition of the music piece. Thus, a snapshot is taken before the beginning of the playing of the music piece for recording the specific position of the cycles from which it starts. The user stores the snapshots they like and deletes the snapshots he did not like based on the rendition of the music piece. Each stored snapshot can be given a unique name by the user, but is also assigned a numeric value (e.g. between 1 and 127).

If the user likes one of the snapshots for all instruments, he may recall that single snapshot for all instruments. If the user liked different snapshots for different instruments, he may recall them separately. The user may also create and recall either a single snapshot at the beginning of the piece or several snapshots for the various sections of the musical piece (beginning, middle, end, etc.).

According to one embodiment of the invention, recalling a specific snapshot includes inserting a MIDI note event to the sequenced part of the instrument. The selected MIDI note is outside the playable range of the instrument. In this regard, the selected MIDI key note is much like a key switch, but the note is not only outside the playable range of the instrument, but also outside the range of a standard 88 keys (the physical MIDI keyboard) and yet inside the range of the virtual 127 note range of the standard MIDI protocol. According to one embodiment of the invention, the numeric value of the selected MIDI note (its pitch) is (like a key-switch) assigned to the snapshot recall feature, and the velocity value of the selected MIDI note-event (normally is determined by how loud the note has been played, but can be easily and comfortably edited by the user in step-time) determines which snapshot will be recalled.

For example, assume that the user would like to recall snapshot number 23, and that the note activating the snapshot recall is G-1. At the beginning of a MIDI track for a specific instrument, the user adds (with the pencil tool in the note editor) a note event playing a G-1 (which is below the limits of the physical keyboard) and assigns to it a velocity value of 23. As soon as the MIDI sequencer plays that note event into the MIDI processor 14, the MIDI processor recalls snapshot number 23 and all loaded cycles of the playing instrument is configured to snap to the stored position. A different note (for example G#-1) could be assigned to the "all instruments" variant, which will enable recalling the cycles of all loaded instruments at once, instead of each instrument separately.

IX. Advanced Alternate-Samples Management Using Accidentals (Overriding the Existing Cycle)

According to one embodiment of the invention, the cycle control module 40 further allows a user to override an existing cycle. This may be done after recalling a snapshot for fine-tuning purposes. In this regard, if the user wants a specific note in a performance to use a specific recorded alternate sample without interfering with the rest of the cycles, the module allows the user to bypass the existing cycles and choose a specific alternate sample for a specific note. According to one embodiment of the invention, this feature works only as long as there are no simultaneous notes played (chord), and is mostly useful with legato (monophonic) instruments.

In overriding a cycle, the user adds a note event in the note-editor of their sequencer, just as they would when trying to recall a snapshot. This time, a different note outside the playable range is used (for example: E-1). According to one embodiment of the invention, the note event is parallel to the affected note (similarly to bi-directional key-switches), and the velocity value assigned by the user determines which alternate sample will be played. This "accidental" approach does not interfere the existing cycles, and similarly to the bi-directional key-switch behavior, after a note-off event of the controlling "note," everything goes back to where it was.

X. Active Dynamic Switching

According to one embodiment of the invention, the virtual key-switch module 34 allows a user to control dynamic changes in musical dynamics (crescendo and diminuendo) in real-time. VKS's are used to trigger a prerecorded crescendo or diminuendo from the currently played dynamic level to whichever other target dynamic level they desire, and do it on the fly and in a selectable speed. Similarly to the above-described active and semi-active key-switches, the VKS's assigned for dynamic switching allows the user to trigger the actual sampled performance of a crescendo or diminuendo as an adjustment to an already played note, allowing for a very fluid and realistic effect. Thus, the user has immediate real-time access to all of the variations of speed and dynamic range in an intuitive manner. Dynamic switching via the VKS's offers the best of both worlds: fluid dynamic change on-the-fly (like the one achieved with the modulation wheel), and the realism and expressiveness that comes with a recording of the real crescendo and diminuendo performance. This feature is especially useful, for example, for bowed strings sampled instrument, and calls for extensive sampling of the many variations it may then offer.

According to one embodiment of the invention, different VKS's are assigned for different selectable speeds. The selected speeds determine the speed of transition from one dynamic level to another. For example, three VKS's may be assigned for respectively fast, moderate, and slow speeds. The user plays the melody with his or her right hand, and uses the VKS's to activate the dynamic changes based on the velocity of the VKS that is pressed (i.e. how hard or soft the VKS is pressed). If for example the user is playing softly, he or she can trigger a crescendo by pressing one of VKS's with a specific transition speed, with a higher velocity than the already played note. The user can then generate a diminuendo to an even softer dynamic if he or she presses the same virtual-key-switch again, only this time with a lower velocity (softer) than the played note.

Figure 10:
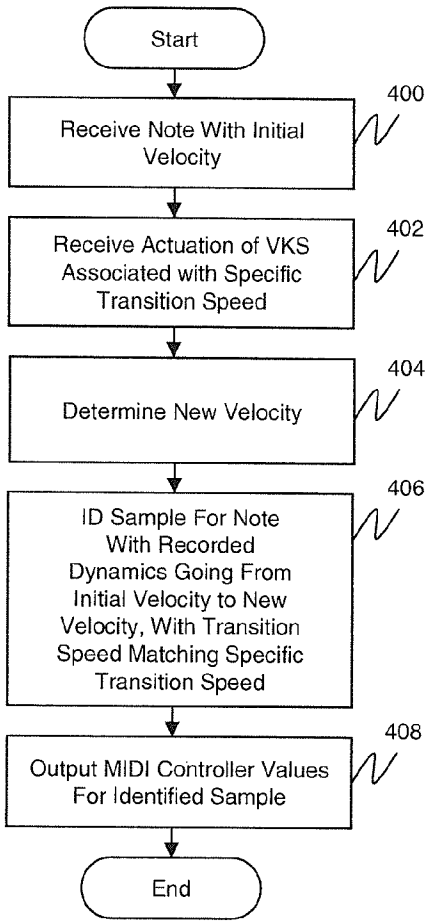
FIG. 10 is a flow diagram of a process for changing dynamics on the fly according to one embodiment of the invention.

FIG. 10 is a flow diagram of a process for changing dynamics on the fly according to one embodiment of the invention. The process starts, and in step 400, the virtual key-switch module receives a playable note played with an initial velocity.

In step 402, the virtual key-switch module receives actuation of a VKS associated with a specific transition speed.

In step 404, the virtual key-switch module determines a new velocity based on the velocity in which the VKS was pressed.

In step 406, the virtual key-switch module identifies a sample for the played note that has a recorded dynamics going a sampled dynamic level containing the initial velocity to the sampled dynamic level containing the new velocity, and having a transition speed matching the transition speed of the actuated VKS.

In step 408, the virtual key-switch module outputs MIDI controller values that correspond to the identified sample.

XI. Bow Direction Control

Based on the "Bi-Directional key-switches", this feature allows the user do force the articulation cycle of bowing direction of bowed strings instruments momentarily. Imitating a live string section, if not told otherwise, they will keep changing bow direction. Our system will keep cycling between the two directions (up and down) unless using this feature by pressing (or pressing and holding) a virtual key-switch to force a specific direction. When using this special key-switch with the modifying "shift" or "option" keys it will allow the user to switch bow direction within an existing note (functioning as a semi-active virtual key switch).

IX. Operation

The following are descriptions of exemplary operation modes of the advanced MIDI and audio processing system according to one embodiment of the invention.

1. Standalone Mode without Using a MIDI Sequencer

The user launches the modules in the MIDI processor 14, then launches the audio engine (the sample player) and loads an instrument. The user then chooses the proper instrument preset in the MIDI processor and chooses both the port and channel for MIDI input (in this case—the one connected to the physical MIDI keyboard 10) and the port and channel for MIDI output to be sent to the sample player. Then the user makes sure to choose the corresponding port and channel in the sample player to receive the MIDI signal sent by the MIDI processor.

2. Standalone/Rewire Hybrid Mode (with a MIDI Sequencer)

In this mode, the sample player is launched in a hybrid mode which enables it to be connected directly to the audio mixer of the hosting MIDI sequencer via "Rewire," while receiving MIDI input not from the MIDI sequencer 12 but rather from a virtual MIDI port used by the MDI processor 14. In this mode, the user first launches the MIDI sequencer 12 creating one MIDI track for each instrument (the user may use more than one track if desired, but additional tracks are not required). This MIDI track is setup to receive MIDI directly from the physical MIDI keyboard 10 and to output MIDI to the virtual MIDI port corresponding to the one defined by the MIDI processor for that instrument. This MIDI track is also used for recording the user's performance as a chain of MIDI events generated by the physical MIDI keyboard and editable within the MIDI sequencer by the user. According to one embodiment of the invention, this MIDI track does not include any of the MIDI information generated by the MIDI processor 14, but rather only the MIDI information entered by the user. The user also makes sure to choose the corresponding port and channel in the sample player to receive the MIDI signal sent by the MIDI processor 14.

Using this routing method maintains full editing flexibility for the user and a simple workflow (only a single MIDI track is required per instrument) and yet maintains the advantage of being connected via Rewire directly into the MIDI sequencer's audio mixer. Being able to use the MIDI processing software as a standalone application and implementing the audio processing functionality as an audio plug-in hosted by the MIDI sequencer, allows the full functionality of MIDI and audio processing as described above.

3. Virtual Instrument Plug-in Mode with MIDI Processing Standalone Program

According to one embodiment, using virtual instrument plug-in mode with the MIDI processing program in standalone mode, uses two MIDI tracks in the MIDI sequencer for each instrument. The first track is used for recording the MIDI performance as it is performed by the user, receiving MIDI information directly from the physical MIDI keyboard and sending MIDI to a virtual MIDI port connected to the MIDI processor 1. Just like in the modes mentioned above, the instrument presets and respective MIDI channels and ports are setup for the proper instruments in an instrument slot in the MIDI processor 14, and from there the processed MIDI signal is sent to the other MIDI track in the MIDI sequencer through another virtual MIDI port. The second MIDI track in the MIDI sequencer receives the already processed MIDI signal from the MIDI processor 14 by routing the proper virtual MIDI port as an input and filtering the irrelevant MIDI channels of that port, leaving only the relevant MIDI channel. This second MIDI track is put in "monitor mode", which makes it "listen" to the proper MIDI input even when the track is not selected for recording. The virtual instrument plug-in (audio engine) is launched in the hosting MIDI sequencer and is routed to the output of the second MIDI track in the MIDI sequencer, which means the processed MIDI signal is eventually sent to the audio engine (the sample player in the form of a virtual instrument plug-in). According to one embodiment, the processed MIDI signal does not have to be recorded. The second MIDI track is only there in order to enable routing the incoming MIDI information to the virtual instrument plug-in.

In this mode, the MIDI signal is also routed from the MIDI send effects panel of the second track into the audio plug-in (the Audio Processing Functionality). The audio plug-in itself is used as an insert effect put on the proper audio output of the virtual instrument plug-in (the audio engine), as it appears in the hosting MIDI sequencer's software audio mixer.

4. Real-Time Operation Using Monophonic "Legato" Instruments

According to one exemplary real-time operation, a user's left hand triggers the various virtual key-switches on the left part of the physical MIDI keyboard while his right hand plays the desired music melody on the right side of the MID keyboard. Whenever a musical note is played by the user before the former played note is released, a legato note-transition is triggered, unless the user selects a non-legato articulation by triggering corresponding virtual key-switches.

The MIDI processor 14 receives the user's MIDI input (either from the physical MIDI keyboard or, if working with a MIDI sequencer, from the sequencer's recorded track), analyzes it and generates MIDI output to the sample player. MIDI notes within the playable range of the instrument are treated as described in the description for the Note Transition component. MIDI notes within the range of defined virtual key-switch triggers are handled as described in the Virtual Key-Switch component—they trigger different virtual key-switches and by that change the current state of the instrument which corresponds to a desired musical articulation or style.

5. Real-Time Operation Using Polyphonic Instruments

In this mode, the operation is the same as in the previous mode, with one exception: even if the user plays a new note before releasing a formerly played note, a note transition will not be triggered but instead will be played additionally and will create a chord (multiple simultaneous notes may be played). According to one embodiment, the only pre-recorded note-transition that may be triggered in this mode is repetition (or "legato in prima"). If more than one style of repetition was recorded (legato, smear-legato, etc), it is possible to activate all available styles of repetition by using the virtual sustain pedal (or the actual sustain pedal) and any of the relevant virtual key-switches 6. Working with a MIDI & Audio Sequencer Working with a MIDI & audio sequencer enables the 2 real-time operation modes mentioned above, but additionally enables a non-real-time workflow as follows:

A. Editing the Virtual Key-Switch Information on a Single MIDI Track

After recording the user's performance onto a MIDI track, the user may use the hosting MIDI sequencer's track editing window. The virtual key-switch recorded by the user while recording the track appears as MIDI notes and may be edited as such (they may be changed, moved, deleted or added as necessary). The user may also prevent a legato note-transition from being triggered by making sure MIDI notes do not overlap, or create a legato note-transition where it was not originally played by changing the lengths and/or positions of the recorded MIDI notes so that they do overlap.

B. Recording Virtual Key-Switches as a "Second Pass" onto the Same MIDI Track of the Hosting Midi & Audio Sequencer Using this approach, the user first plays only the melody (and/or harmony) without triggering any virtual key-switches, and then either records virtual key-switches in a second pass on the same MIDI track. According to one embodiment, the MIDI sequencer 12 enables users to record MIDI tracks in mix mode, which instead of overwriting the existing MIDI data on the track while recording onto it, it mixes the new MIDI data performed by the user with the existing data on the track) or the user, similarly to the previous approach, may add the MIDI notes that represent the virtual key-switch in the "track editing" window in the hosting MIDI sequencer. This approach may be used especially when trying to perform a fast-paced musical phrase which requires several virtual key-switches to be triggered in an accurate manner.

C. Using a Separate MIDI Track in the MIDI Sequencer for Virtual Key-Switches

Using a separate MIDI track in the MIDI sequencer for virtual key-switches means that more than one MIDI track in the hosting MIDI sequencer is routed to send MIDI information towards the MIDI processor 14, while the first track is used for recording just the MIDI notes of the melody or harmony, and the second MIDI track (routed to the same MIDI channel and port) is being used for the recording of only MIDI notes that represent virtual key-switches as they are played by the user. Using this approach of operation has one simple advantage over the approach B mentioned above. It enables the user to transpose the MIDI notes representing melody and harmony recorded on the first MIDI track of the instrument using automatic transposition features of the MIDI sequencer without affecting nor altering the MIDI notes representing virtual key-switches.

D. Using Separate MIDI Tracks in Real-Time

This approach is almost identical to C. However, both tracks are recorded simultaneously. This approach retains the advantage of being able to automatically transpose only music notes without affecting virtual key-switch notes, but also enables the simultaneous performance of melody and virtual key-switches as performed in the real-time approach. According to one embodiment of the invention, this is done by splitting the MIDI signal coming from the physical MIDI keyboard into two separate MIDI channels routed into two separate MIDI tracks in the MIDI sequencer, that are setup to record simultaneously.

A person of skill in the art should appreciate that the advanced MIDI and audio processing system according to the various embodiments of the present invention allows for intuitive, real-time access to a large number of different patches of sound samples based on musical context via smaller, more manageable amount of actual physical controlling keys. This helps to provide an easy and intuitive workflow for generating complex MIDI information for gaining more realistic sounding MIDI music productions.

Although this invention has been described in certain specific embodiments, those skilled in the art will have no difficulty devising variations to the described embodiment which in no way depart from the scope and spirit of the present invention. For example, although the above embodiments are described in the context of MIDI processor 14 that is separate from the sample player, 16, a person of skill in the art should recognize that the MIDI processor may be implemented as part of the sample player. In this case, no MIDI data need to be exchanged between them. For example, MIDI messages such as "note-on" and "note-oft~" messages would simply be replaced with the action of triggering a note and stopping the current note, respectively. Thus, although the above embodiment anticipate the generating of MIDI information for passing between the MIDI processor 14 and the sample player, the functionality described with respect to those embodiments will not change even if no MIDI information is generated. The term "processor," as used herein, may refer to a single processor or multiple processors.

Furthermore, to those skilled in the various arts, the invention itself herein will suggest solutions to other tasks and adaptations for other applications. It is the applicant's intention to cover by claims all such uses of the invention and those changes and modifications which could be made to the embodiments of the invention herein chosen for the purpose of disclosure without departing from the spirit and scope of the invention. Thus, the present embodiments of the invention should be considered in all respects as illustrative and not restrictive, the scope of the invention to be indicated by the appended claims and their equivalents rather than the foregoing description.

What is claimed is:

1. A method for activating alternate audio samples recorded for a particular musical note, the method comprising:

accessing, by a processor, a first plurality of alternate audio samples for a first musical note having a first pitch, a first articulation, and a first dynamic layer, and a second plurality of alternate audio samples for a second musical note having a second pitch, a second articulation, and a second dynamic layer;

cycling, by the processor, through the first plurality of alternate audio samples for playing the first musical note independently from the cycling through the second plurality of alternate audio samples for playing the second musical note; and triggering, by the processor, the playback of one of the first plurality of alternate audio samples and one of the second plurality of alternate audio samples based on respective positions of the corresponding cycles, wherein the cycling comprises storing a first position of a first cycle of the first plurality of alternate audio samples and storing a second position of a second cycle of the second plurality of alternate audio samples, and wherein the triggering comprises updating the first position when the first musical note is played and updating the second position when the second musical note is played, the first position being updated independently of the second position.

2. The method of claim 1, wherein the first pitch and the second pitch are equal, and the first articulation and the second articulation are different.

3. The method of claim 1, wherein the first pitch and the second pitch are equal, and the first dynamic layer and the second dynamic layer are different.

4. The method of claim 1, wherein the first pitch and the second pitch are different, the first articulation and the second articulation are equal, and the first dynamic layer and the second dynamic layer are equal.

5. The method of claim 1, wherein a number of steps of the first cycle is different from a number of steps of the second cycle.

* * * * *